United States Patent [19]

Sato

[11] Patent Number: 4,617,851

[45] Date of Patent: Oct. 21, 1986

[54] HYBRID ELECTRONIC MUSICAL INSTRUMENT

[75] Inventor: Kunio Sato, Tokyo, Japan

[73] Assignee: Casio Computer Co., Ltd., Tokyo, Japan

[21] Appl. No.: 605,688

[22] Filed: Apr. 30, 1984

[30] Foreign Application Priority Data

| | | | |
|---|---|---|---|
| May 10, 1983 | [JP] | Japan | 58-80046 |
| May 10, 1983 | [JP] | Japan | 58-80047 |
| Jun. 3, 1983 | [JP] | Japan | 58-98036 |
| Jun. 3, 1983 | [JP] | Japan | 58-83842[U] |

[51] Int. Cl.[4] ..... G10H 1/02; G10H 7/00

[52] U.S. Cl. ..... 84/1.19; 84/1.24; 84/DIG. 4

[58] Field of Search ..... 84/1.01, 1.11–1.13, 84/1.17, 1.19–1.24, 1.27, 115, 470 R, DIG. 4

[56] References Cited

U.S. PATENT DOCUMENTS

| | | | |
|---|---|---|---|
| 3,470,785 | 10/1969 | Shallenberger et al. | 84/470 R |
| 3,478,159 | 11/1969 | Olson | 84/1.17 |
| 3,541,915 | 11/1970 | Rhodes | 84/1.01 X |
| 3,695,138 | 10/1972 | Andersen | 84/470 R |
| 3,782,237 | 1/1974 | Okamoto | 84/470 R |
| 3,871,247 | 3/1975 | Bonham . | |
| 4,320,683 | 3/1982 | Whitefield | 84/115 |
| 4,361,067 | 11/1982 | Ishii | 84/1.27 |
| 4,402,246 | 9/1983 | Sekiguchi | 84/1.19 |
| 4,538,495 | 9/1985 | Sato | 84/1.19 |

FOREIGN PATENT DOCUMENTS 3103801A 1/1982 Fed. Rep. of Germany .

*Primary Examiner*—S. J. Witkowski

*Attorney, Agent, or Firm*—Frishauf, Holtz, Goodman & Woodward

[57] ABSTRACT

Two electronic musical instruments are supported in combination on a stand. The electronic musical instruments have respective switch sections each for setting a plurality of different timbres which are different from those which can be set by the other. When transfer mode switches of both the instruments are "on", timbre data set in one electronic musical instrument is transferred to the other electronic musical instrument through a cable, so that tones with the same timbre are sounded from loudspeakers connected to the respective instruments.

9 Claims, 26 Drawing Figures

FIG. 7

| | |
|---|---|
| 1 1 1 0 | TIMBRE DATA TRANSMISSION/ RECEIPT |

FIG. 8

| | |
|---|---|
| 0 a3 a2 a1 | X ; a3 a2 a1 ( 0 ≤ X ≤ 7 ) |
| 1 a6 a5 a4<br>0 a3 a2 a1 | X ; a6 a5 a4 a3 a2 a1 ( 8 ≤ X ≤ 63 ) |
| 1 a9 a8 a7<br>1 a6 a5 a4<br>0 a3 a2 a1 | X ; a9 a8 a7 a6 a5 a4 a3 a2 a1<br>( 64 ≤ X ≤ 255 ) |

FIG. 9

| | |
|---|---|
| 0 0 1 1 | TIMBRE DATA REQUEST |
| 0 0 0 1 | TIMBRE DATA TRANSFER |

FIG. 10

| | | |
|---|---|---|
| WAVEFORM | 16 | a416 a316 a216 a116 b416 b316 b216 b116 |
| | 15 | a415 a315 a215 a115 b415 b315 b215 b115 |
| | ⋮ | ⋮ |
| | 2 | a402 a302 a202 a102 b402 b302 b202 b102 |
| | 1 | a401 a301 a201 a101 b401 b301 b201 b101 |
| ENVELOPE DATA | | A3 A2 A1 D3 D2 D1 S3 S2 S1 R3 R2 R1 |
| FILTER | | 0 f3 f2 f1 |
| VIBRATO | | 0 V3 V2 V1 |
| OCTAVE | | 0 0 O2 O1 |

HYBRID ELECTRONIC MUSICAL INSTRUMENT

BACKGROUND OF THE INVENTION

This invention relates to a hybrid electronic musical instrument which uses two or more electronic musical instruments in combination.

When a piece of music is performed using an electronic musical instrument, a timbre which is matched to the mood of the music is selected. When the mood of music changes during the course thereof, the timbre also has to be changed to match the altered mood. However, there are only a limited number of different timbres that can be set with one electronic musical instrument, so that it sometimes happens that no timbre matched to the mood of music can be set. Accordingly, it has been proposed to have two or more electronic musical instruments at hand, which individually permit respective pluralities of different timbres, and set desired timbres one after another during the progress of music performance.

Ensemble is one form of music performance with two or more electronic musical instruments. In this case, at least the electronic musical instruments which are used for ensemble must be capable of setting the same timbre. Even for ensemble, it is desirable to be able to select a timbre among a plurality of different timbres. In the long run, the total number of different timbres that can be set with a combination of a plurality of electronic musical instruments can not be increased very much.

SUMMARY OF THE INVENTION

An object of the invention, accordingly, is to provide a hybrid electronic musical instrument comprising a plurality of electronic musical instruments, which permits ensemble performance with an increased number of different timbres which are capable of being selected for the electronic musical instruments which are employed for performance.

According to the invention, there is provided a hybrid electronic musical instrument, which comprises at least two tone generation units including respective timbre information setting means and which generate respective tones according to timbre information set by these timbre information setting means, means for transferring timbre information set by one of the tone generation units to other tone generation unit or units, and means for driving the other tone generation unit or units according to the timbre information transferred by the trasferring means.

BRIEF DESCRIPTION OF THE DRAWINGS

FIG. 7 is a view showing an operation code representative of timbre data transmission/reception;

FIG. 8 is a view showing number of digits data;

FIG. 9 is a view showing timbre data request data and timbre data transfer data;

FIG. 10 is a view showing timbre data;

DETAILED DESCRIPTION OF THE PREFERRED EMBODIMENTS

Figure 1:
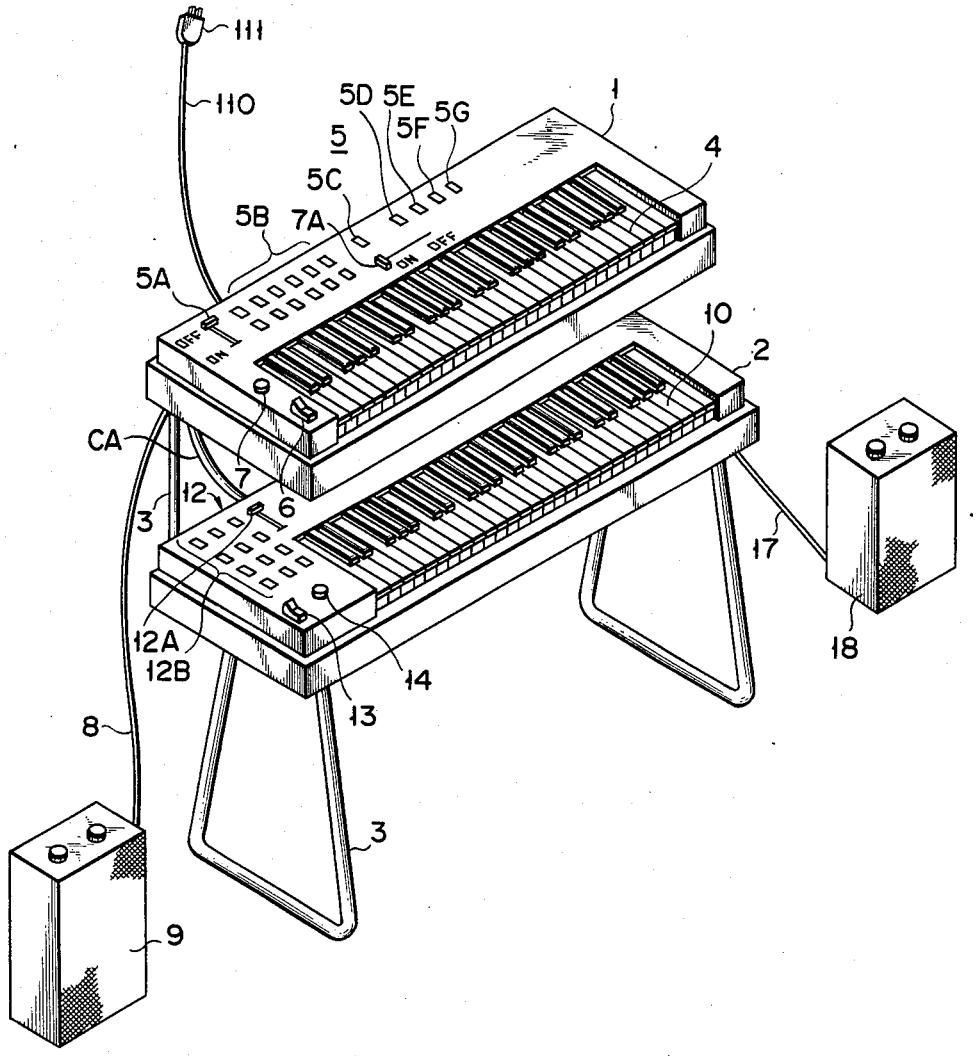
FIG. 1 is a perspective view showing an embodiment of the hybrid electronic musical instrument according to the invention.

The invention will now be described in conjunction with preferred embodiments thereof with reference to the accompanying drawings. FIG. 1 shows an embodiment of the hybrid electronic musical insrtrument according to the invention. The embodiment comprises two keyboard type electronic musical instruments 1 and 2 which are supported one above another by a stand 3. These electronic musical instruments 1 and 2 have the same construciton and are connected to each other by a cable CA. External loudspeakers 9 and 18 are connected to the electronic musical instruments 1 and 2 via cables 8 and 17.

Figure 5:
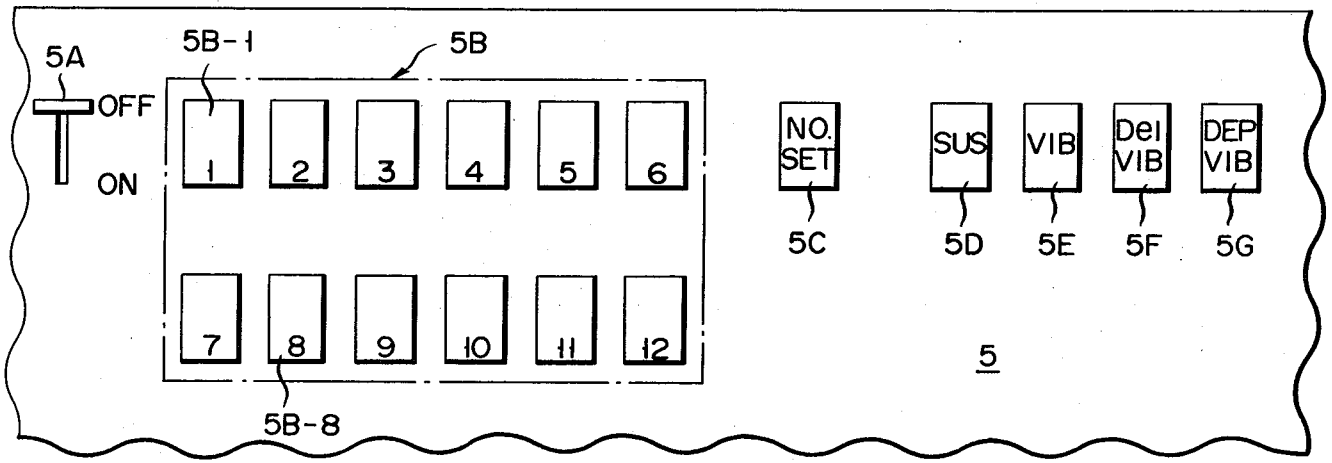
FIG. 5 is a view showing the arrangement of switches in a switch input section shown in FIG. 1.

The upper electronic musical instrument 1 has a 4-octave keyboard 4 which permits manual play of melody. It also has a switch input section 5 which is provided at the rear part of the keyboard 4 and has various switches. The switch input section 5 is shown in detail in FIG. 5. As is shown, it includes a transfer mode switch 5A, which permits transfer of timbre data with respect to the other electronic musical instrument 2. It also includes a timbre switch section 5B for setting various timbres such as piano and organ. It further includes a timbre number set switch 5C, which is operated together with a desired timbre switch in the timbre switch section 5B for the transfer of the designated timbre data to the other electronic musical instrument 2. It further includes effect switches, i.e., a sustain switch 5D, a vibrato switch 5E, a delay vibrato switch 5F and a deep vibrato switch 5G. The electronic musical instrument 1 further has a power switch 6 and a volume control knob 7.

The lower electronic musical instrument 2, like the electronic musical instrument 1, has a 4-octave keyboard 10, a transfer mode switch 12A, a timbre switch section 12B, a power switch 13 and a volume control knob 14. The timbre switch section 12B has timbre switches for setting 12 different timbres other than those of the timbre switches in the timbre switch section 5B, e.g., flute and violin. Although not shown, the electronic musical instrument 2 further has a timbre number set switch and various effect switches.

Figure 2A:
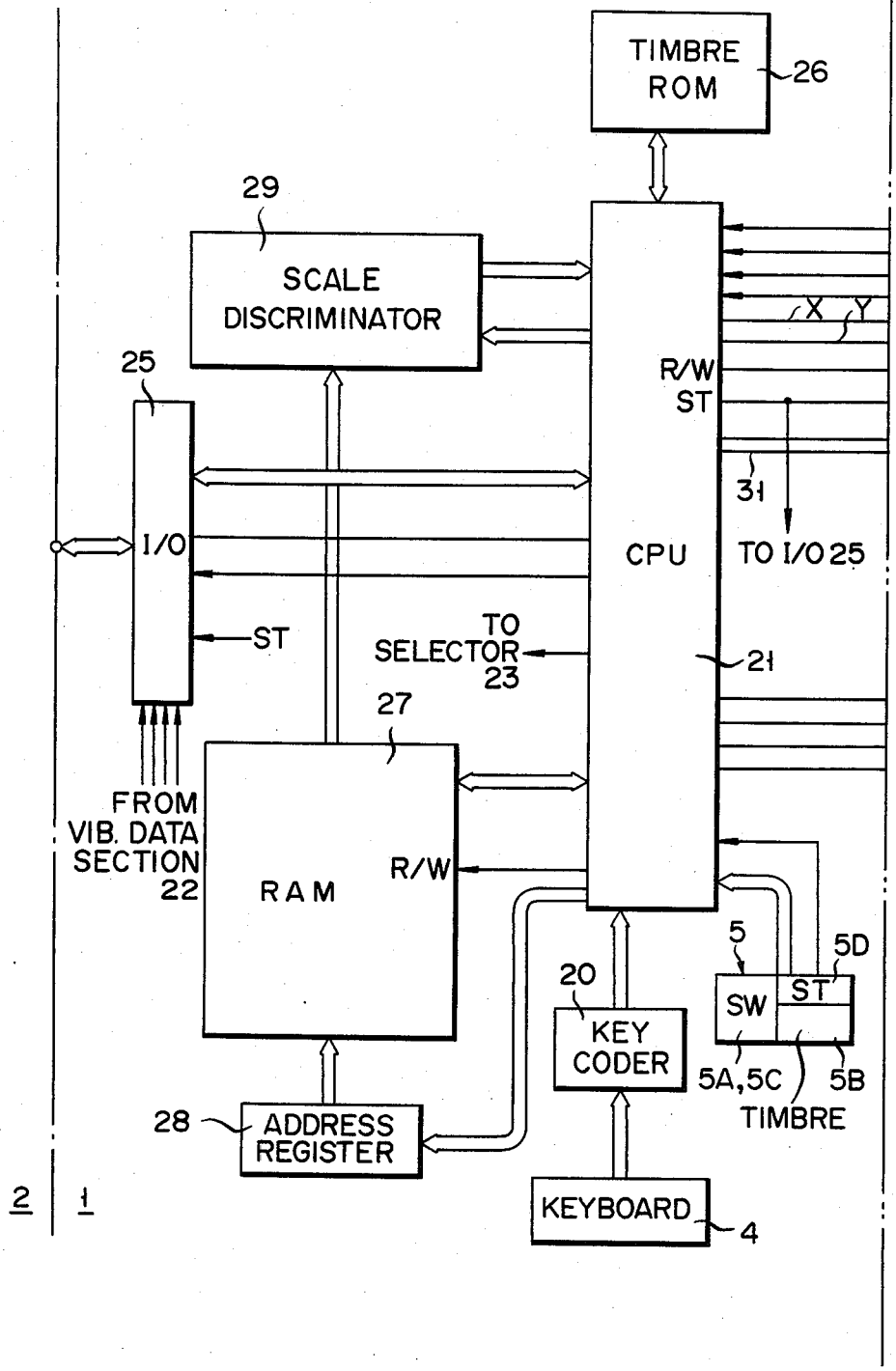
FIGS. 2A and 2B show a block diagram representing the circuit construction of an electronic musical instrument shown in FIG. 1.
Figure 2B:
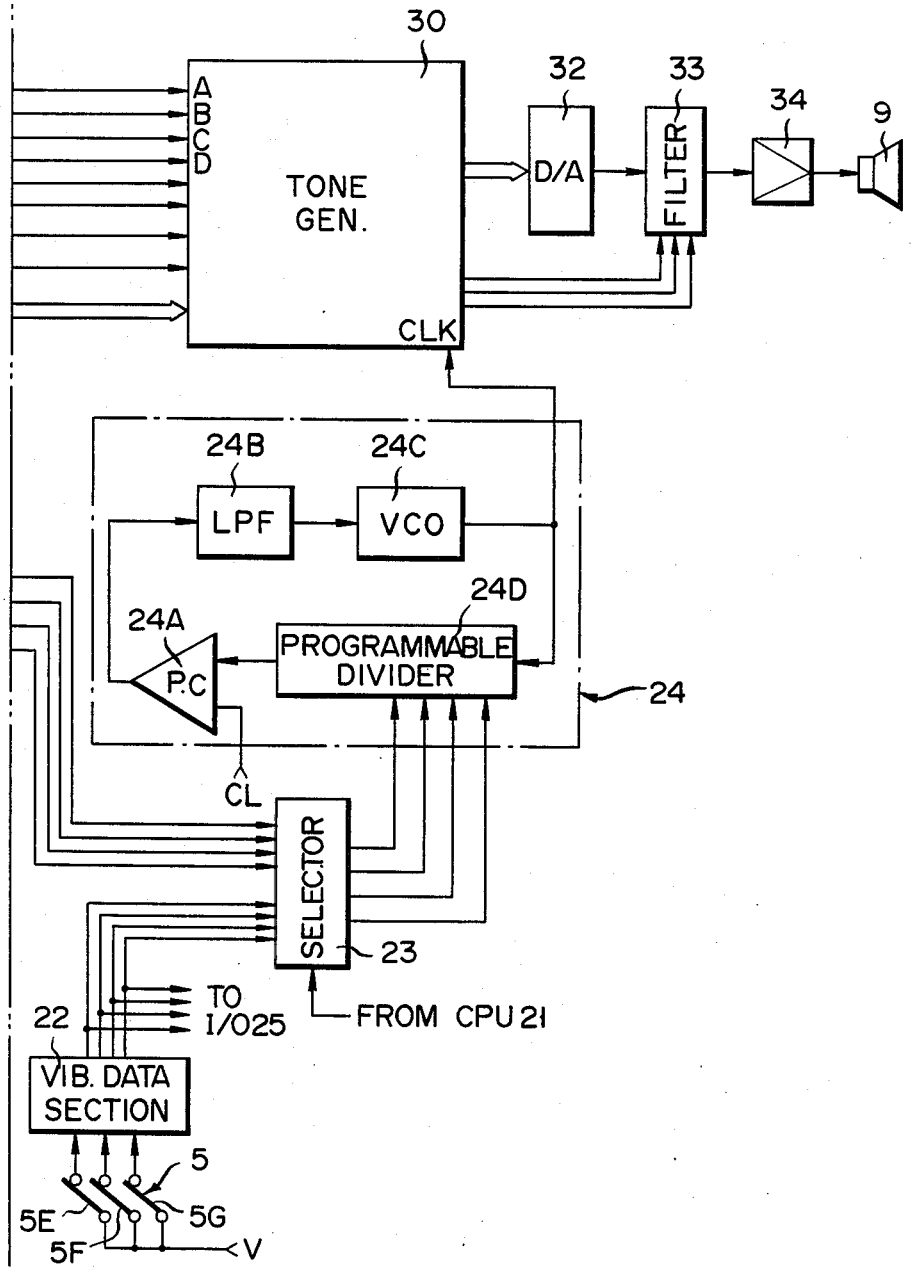

The circuit construction of the upper electronic musical instrument 1 will now be described with reference to FIGS. 2A and 2B. Key operation signal from the keys in the keyboard 4 is fed to a key coder 20, which produces a key code signal corresponding to each operated key, the key code signal being fed to a CPU 21. The CPU 21 controls all operations of the upper electronic musical instrument 1. It may consist of a microprocessor.

Outputs of the transfer mode switch 5A, timbre switch section 5B, timbre number set switch 5C and sustain switch 5D in the switch input section 5 are fed directly to the CPU 21. Outputs of the vibrato switch 5E, delay vibrato switch 5F and deep vibrato switch 5G, on the other hand, are fed to a vibrato data section 22 for conversion to corresponding vibrato data. The vibrato data is fed through a selector 23 to a phase-locked loop (PLL) circuit 24 to be described later. It is also transferred to the lower electronic musical instrument 2 through an input/output (I/O) port 25.

Timbre data is stored in a timbre ROM 26.

A random access memory (RAM) 27 stores timbre data, which is provided from the timbre ROM 26 according to switch operation in the switch input section 5 and coupled through the CPU 21. The timbre data includes of waveform data, envelope data, filter control data, vibrato data and octave data. The RAM 27 is controlled for reading and writing of data by a read/-write control signal R/W from the CPU 21, and its addresses are desig nated by address data provided from the CPU 21, whereby data is transferred between the CPU 21 and RAM 27. The octave data, however, is fed to a scale discriminator 29. The octave data is provided because the compass varies with the timbre set by the timbre switch section 5B. The scale discriminator 29 discriminates the octave data according to the input key code signal and converts it into octaves corresponding to the timbre, and it feeds the result to the CPU 21.

Timbre data read out from the RAM 27 is fed to a tone generator 30 through input/output terminals A to D thereof. Also, read/write control signal R/W from the CPU 21, signal ST produced by operation of the sustain switch 5D and the key code signal through a data bus 31 are fed to the tone generator 30. The tone generator 30 generates tone signal under the control of a clock CLK provided from the PLL circuit 24, the tone signal generated being fed to a D/A converter 32. The D/A converter 32 converts the tone signal into an analog tone signal which is fed to a filter 33. The filter 33 effects timbre control according to filter data provided from the tone generator 30. The tone signal provided from the filter 33 is amplified by an amplifier 34 and then sounded as music sound from the loudspeaker 9. The signal ST is also transferred to the lower electronic musical instrument 2 through the I/O port 25 so that sustain effect is provided simultaneouysly to both the electronic musical instruments 1 and 2.

The PLL circuit 24 includes a phase comparator 24A, a low-pass filter (LPF) 24B serially connected to the output side of the phase comparator 24A, a voltage-controlled oscillator (VCO) 24C and a programmable divider 24D. The phase comparator 24A receives a clock CL at a predetermined frequency fed to one input terminal and the output of the programmable divider 24D fed to the other input terminal. The output of the VCO 24C is fed as the clock CLK to the tone generator 30. Vibrato data set for each timbre provided from the RAM 27 through the CPU 21 or vibrato data from the vibrato data section 22 or vibrato data provided from the lower electronic musical instrument 2 through the CPU 21 is fed through selector 23 to the programmable divider 24D. The programmable divider 24D performs an operation of frequency division according to the input vibrato data. The selector 23 selectively passes either vibrato data from the vibrato data section 22 or vibrato data from the lower electronic musical instrument 2 according to a control signal from the CPU 21.

Figure 3A:
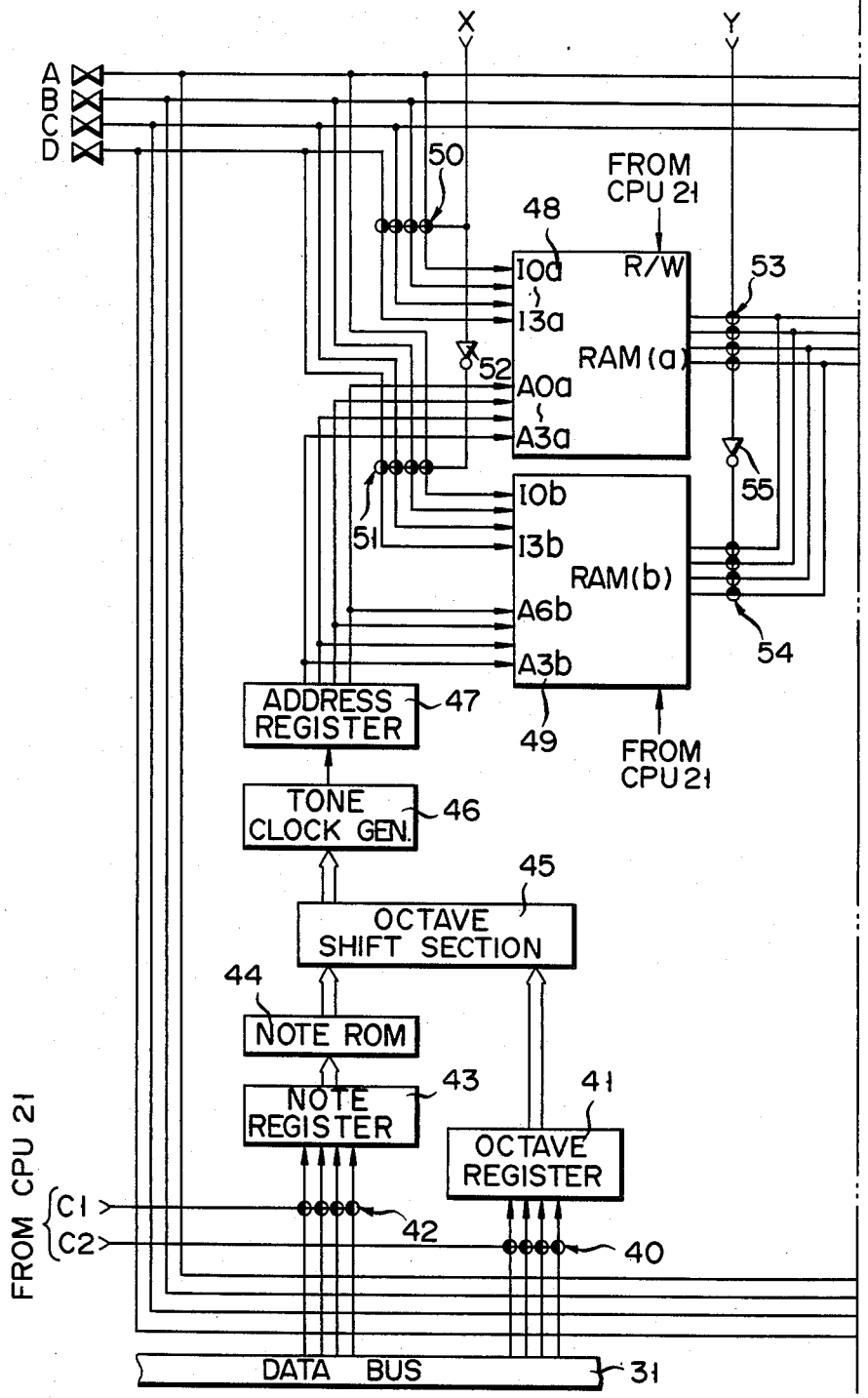
FIGS. 3A and 3B show a block diagram showing a tone generator shown in FIG. 2.
Figure 3B:
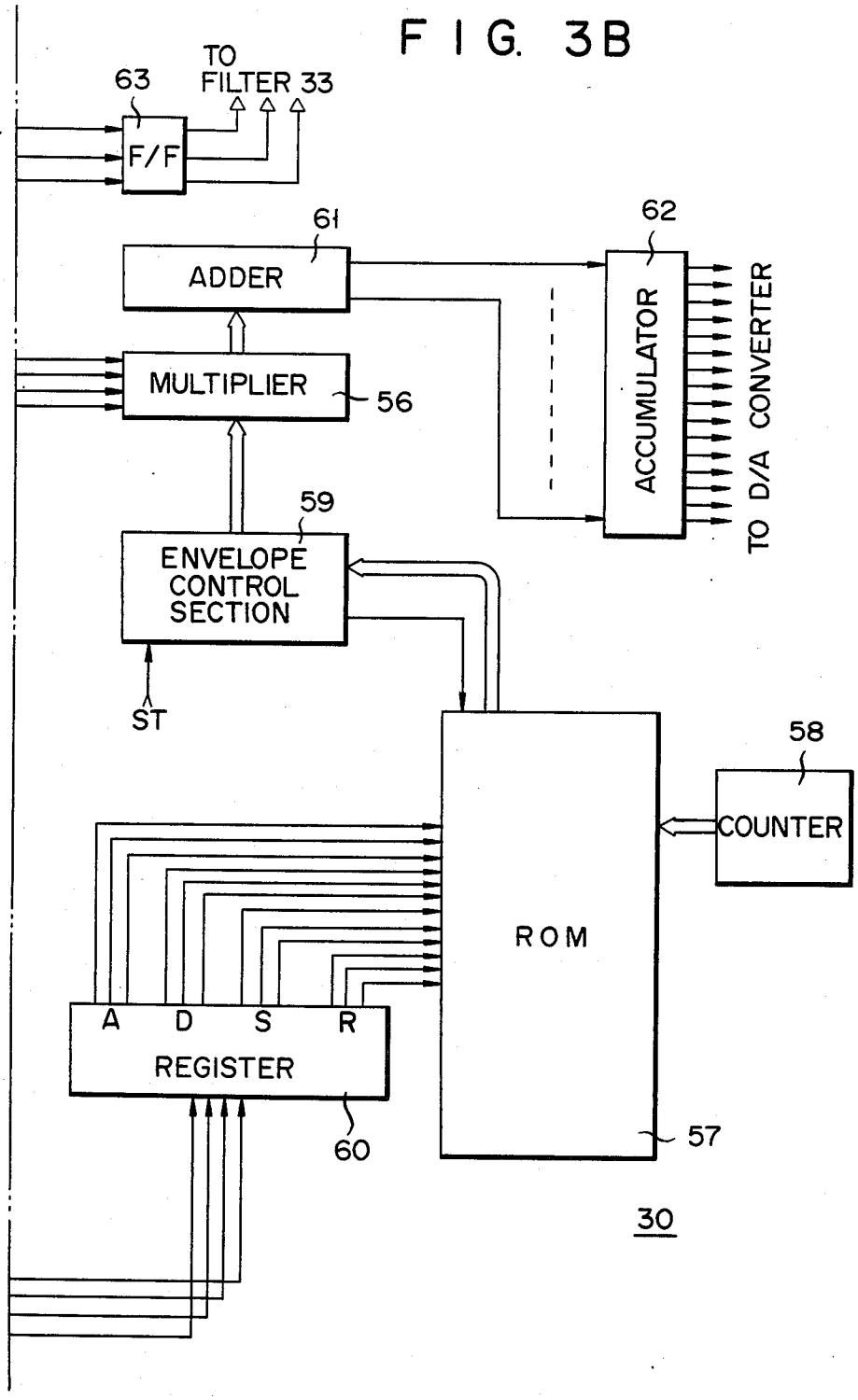

The specific circuit construction of the tone generator 30 will now be described with reference to FIGS. 3A and 3B. An octave code (consisting of 4 bits) which constitutes the key code noted above fed from the CPU 21 through the data bus 31, is fed to an octave register 41 through a gate circuit 40 which consists of four transfer gates. A note code (consisting of 4 bits) is fed to a note register 43 thorugh a gate circuit 42 which again consists of four transfer gates. The octave code is fed to an octave shift section 45, while the note code is fed to a note ROM 44. Note data read out from the note ROM 44 according to the note code input thereto is fed to the octave shift section 45. The octave shift section 45 shifts the input note code to lower bits by a predetermined number of bits according to the input octave code to obtain note data corresponding to the operated key, the note data thus produced being fed to a tone clock generator 46. The tone clock generator 46 generates a note clock at a frequency corresponding to the inpu note data, the note clock being fed to an address register 47. The address register 47 simultaneously feeds the same address data to address input terminals A3*a* to A0*a* and A3*b* to A0*b* of waveform RAMs 48 and 49, which store waveform data of tone waveforms a and b. The gate circuits 40 and 42 are enabled and disabled by respective gate control signals C2 and C1 provided from the CPU 21.

The waveform data of the tone waveforms a and b stored in the waveform RAMs 48 and 49 are either what has been stored in the RAM 27 by the CPU 21 according to the operation of the timbre switch section 5B in the electronic musical instrument 1 or what is transferred from RAM 27 in lower electronic musical instrument 2 by timbre switch 12B. The waveform data of the tone waveform a is coupled through the CPU 21, input terminals A to D, gate circuit 50 consisting of four transfer gates and data input terminals I3a to I0a to be stored in the waveform RAM 48. The waveform data of the tone waveform b is coupled through I/O port 25, CPU 21, input terminals A to D, gate circuit 51 consisting of four transfer gates and data input terminals I3*b* to I0*b* to be stored in the waveform RAM 49. The gate circuit 51 is enabled and disabled by the output of an inverter 52. At the time of the reproduction of tone, the waveform data having been stored in the waveform RAMs 48 and 49 are read out and fed through gate circuits 53 and 54 each consisting of four transfer gates to a multiplier 56. The gate circuit 54 is enabled and disabled by the output of an inverter 55. The gate circuit 50 is enabled and disabled by a gate control signal X with a duty ratio of 1:1 provided from the CPU 21. The gate control signal X is fed to the gate circuit 51 through the inverter 52 for the gate control thereof. The gate circuits 53 and 54 are enabled and disabled by a gate control signal Y with a duty ratio of 1:1 provided from the CPU 21, the signal being fed directly to the gate circuit 53 and fed through inverter 55 to the gate circuit 54. The RAMs 48 and 49 are controlled for the reading and writing of waveform data by the read/-write control signal R/W from the CPU 21.

Envelope clock frequency data is stored in a ROM 57. An envelope clock which is read out from the ROM 57 according to the count of a counter 58, is fed to an envelope control section 59. Envelope data, i.e., attack, decay, sustain and release data, having been written in the RAM 27 according to the set timbre, is read out into a register 60 and thence fed to the ROM 57. Thus, envelope clocks at frequencies corresponding to the attack, decay, sustain and release as specified by the envelope data noted above, are read out from the ROM 57 and fed to the envelope control section 59. According to these envelope clocks, the envelope control section 59 produces envelope waveform data which is fed to the multiplier 56. The signal ST is also supplied to the envelope control section 59, so that the section 59 effects envelope control such that the sustain state is brought about immediately when the sustain switch 5D is turned on.

The multiplier 56 multiplies tone waveform data, i.e., waveform data of waveforms a and b which are read out alternately from the RAMs 48 and 49, and envelope waveform data, and feeds the result data to an adder 61. The adder 61 is provided because the waveform data is stored as differential values for the reduction of the capacities of the RAMs 48 and 49. The adder 61 thus adds the result data to the previous result data to obtain peak value data of the actual tone waveform which is fed to an accumulator 62. In case where an 8-tone polyphonic electronic musical instrument is used, 8 tones are simultaneously produced in the tone generetor 30 on a time division basis, for instance. The accumulator 62 thus has a function of accumulating tone formation data prepared in 8 individual channels and provided from the adder 61. It feeds the accumulated value to the D/A converter 32 at tne end of time division basis cycle.

A flip-flop 63 is provided for latching the filter data read out from the RAM 27 or filter data transferred from the lower electronic musical instrument 2 and feeding the latched data to the filter 33.

Figure 4:
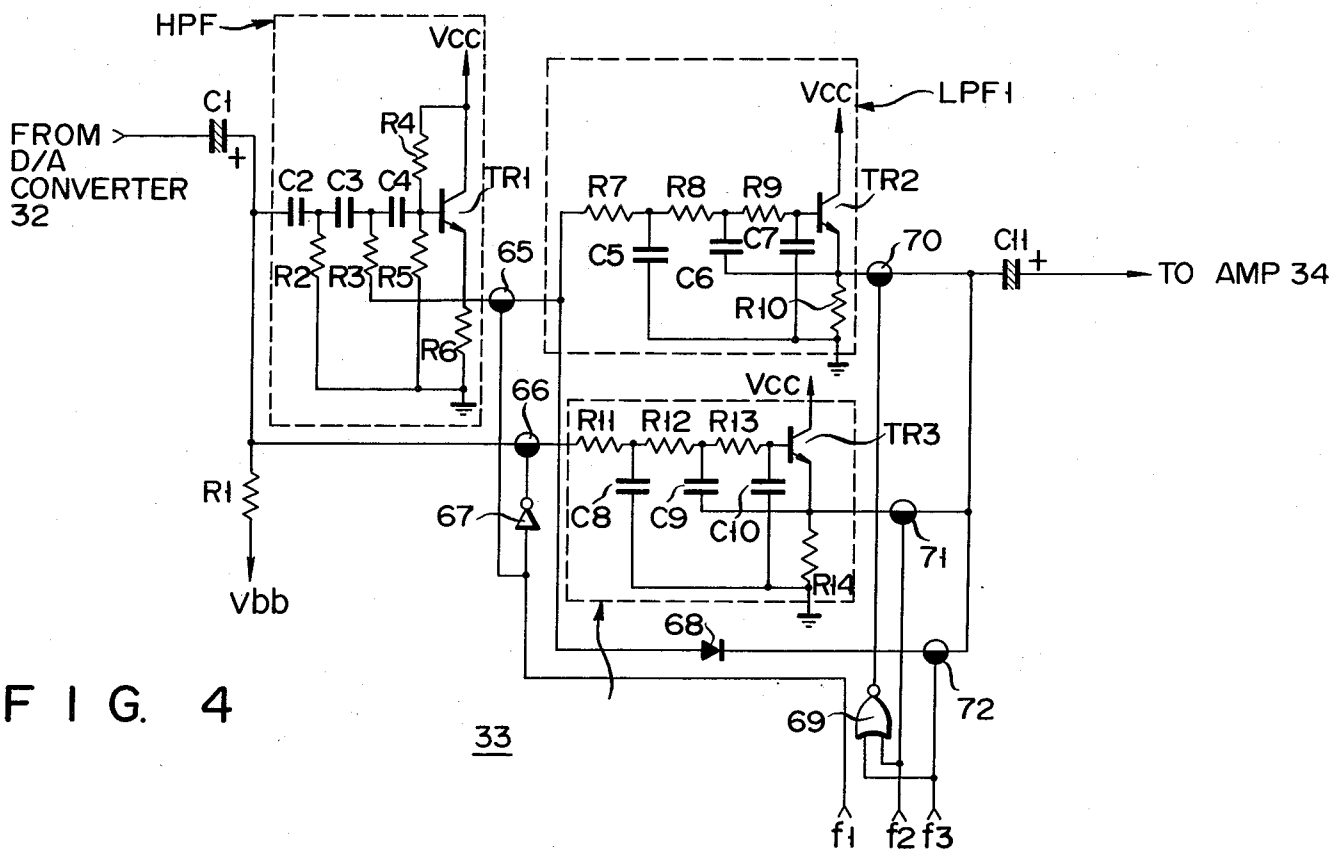
FIG. 4 is a circuit diagram showing a filter shown in FIG. 2.

The specific circuit construction of the filter 33 will now be described with reference to FIG. 4. As is shown, the filter 33 includes a high-pass filter HPF and two low-pass filters LPF1 and LPF2, these filters having respective cut-off frequencies of, for instance, 3.0 kHz, 1.5 kHz and 3.4 kHz. Transfer gates 65, 66 and 70 to 72 are switched according to the filter data f1, f2 and f3 for various timbre controls.

More specifically, the output of the D/A converter 32 is fed through a capacitor C1 to a capacitor C2 in the high-pass filter HPF. A voltage Vbb is applied to the connection point between the capacitors C1 and C2 through a resistor R1. Capacitors C3 and C4 are serially connected to the capacitor C2. The output of the capacitor C4 is applied to the base of an NPN transistor TR1. The connection point between the capacitors C2 and C3 is grounded through a resistor R2. The convection point between the capacitors C3 and C4 is convected to the transfer gate 65 through a resistor R3. A resistor R4 is connected between the collector and base of transistor TR1. The base of the transistor TR1 is grounded through a resistor R5, its emitter is grounded through a resistor R6, and a voltage Vcc is applied to its collector. The output of the high-pass filter HPF, i.e., the output of the emitter of transistor TR1, is fed through the transfer gate 65 to the low-pass filters LPF1 and LPF2. It is further fed through diode 68, transfer gate 72 and capacitor C11 to the amplifier 34.

The low-pass filter LPF1 includes an NPN transistor TR2, resistors R7 to R10 and capacitors C5 to C7. The output of the high-pass filter HPF is fed to the resistor R7. The resistors R8 and R9 are connected in series with the resistor R7. The capacitor C5 has one terminal connected to the connection point between the resistors R7 and R8 and the other terminal grounded. The capacitor C6 has one terminal connected to the connection point between the resistors R8 and R9 and the other terminal connected to the emitter of NPN transistor TR2. The capacitor C7 has one terminal connected to the connection point between the resistor R9 and base of transistor TR2 and the other terminal grounded. The resistor R10 has one terminal connected to the emitter of transistor TR2 and the other terminal grounded. Voltage Vcc is applied ot the collector of transistor TR2, and the emitter output thereof is fed as the output of the low-pass filter LPF1 through transfer gate 70 and capacitor C11 to the amplifier 34.

The low-pass filter LPF2 has entirely the same construction as the low-pass filter LPF1, including an NPN transistor TR3, resistors R11 to R14 and capacitors C8 to C10, except for that the resistance value of the resistors R11 to R13 and capacitance value of the capacitor 10 are different from those of the resistors R7 to R9 and capacitor C7. The output of the low-pass filter LPF2, i.e., the output of the transistor TR3, is fed through transfer gate 71 and capacitor C11 to the amplifier 34.

The first bit f1 of the filter data is fed as gate control signal to the transfer gate 65 directly and also the transfer gate 66 through an inverter 67. The second and third bits f2 and f3 of the filter data are fed as gate control signal to the transfer gate 70 through a NOR gate 69. These bits f2 and f3 are also fed as gate control signal to the respective transfer gates 71 and 72.

Figure 6:
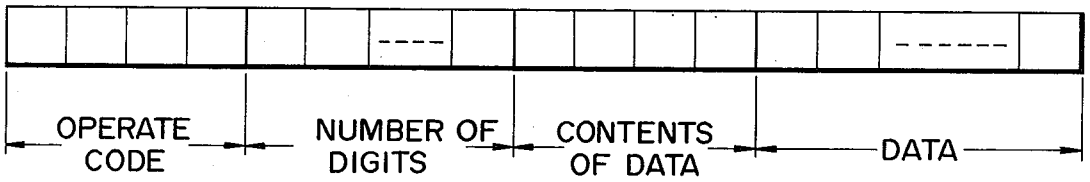
FIG. 6 is a view showing the data format of timbre data transferred between electronic musical instruments.

FIG. 6 shows the format of timbre data transferred between the upper and lower electronic musical instruments 1 and 2. It consists of an operate code as the head, then number of digits data, then contents of data and then data area of actual data.

FIG. 7 shows the content of the operate data which signifies the transfer of timbre data. FIG. 8 shows the contents of the number of digits data. As is shown, when the number x of digits is 0 to 7, an area for one digit is adopted. In this area, the most significant bit is occupied by data "0", and the third, second and first bits are respectively occupied by binary data a3, a2 and a1 representing digit numbers of 0 to 7. When the number x of digits is 8 to 63, an area for two digits is adopted. In the first digit area, the most significant bit is occupied by data "1", and the third, second and first bits are respectively occupied by binary data a6, a5 and a4. In the second digit area, the most significant bit is occupied by data "0", and the third, second and first bits are respectively occupied by binary data a3, a2 and a1. When the number x of digits is 64 to 225, an area for three digits is adopted. The most significant bits of the first to third digit areas are respectively occupied by data "1", "1" and "0". The third, second and first bits of the first to third digit areas are respectively occupied by binary data a9, a8 and a7, a6, a5 and a4 and a3, a2 and a1.

FIG. 9 shows the contents of data. Data "0011" represents a request for timbre data. Data "0001" represents transfer of timbre data.

FIG. 10 shows data structures of waveform data, envelope data, filter data, vibrato data and octave data. The waveform data for both the tone waveforms a and b consist of 16 steps. Each step consists of 8 bits, with the upper 4 bits for the data for the tone waveform a and the lower 4 bits for the data for the waveform b.

The envelope data has a 12-bit data structure with data for attack A, decay D, sustain S and release R individually occupying 3 bits from the most significant bit side in the mentioned order. The filter data is a one-digit data with the most significant bit being "0" and the third, second and first bits being respective data f3, f2 and f1. The vibrato data is also a one-digit data with the most significant bit being "0" and the third, second and first bits being respective data v3, v2 and v1. The octave data is also a one-digit data with the fourth and third bits being "0" and the second and first bits being respective data 02 and 01.

The lower electronic musical instrument 2 is the same in structure as the upper electronic musical instrument 1, so its detailed description is omitted.

Figure 11:
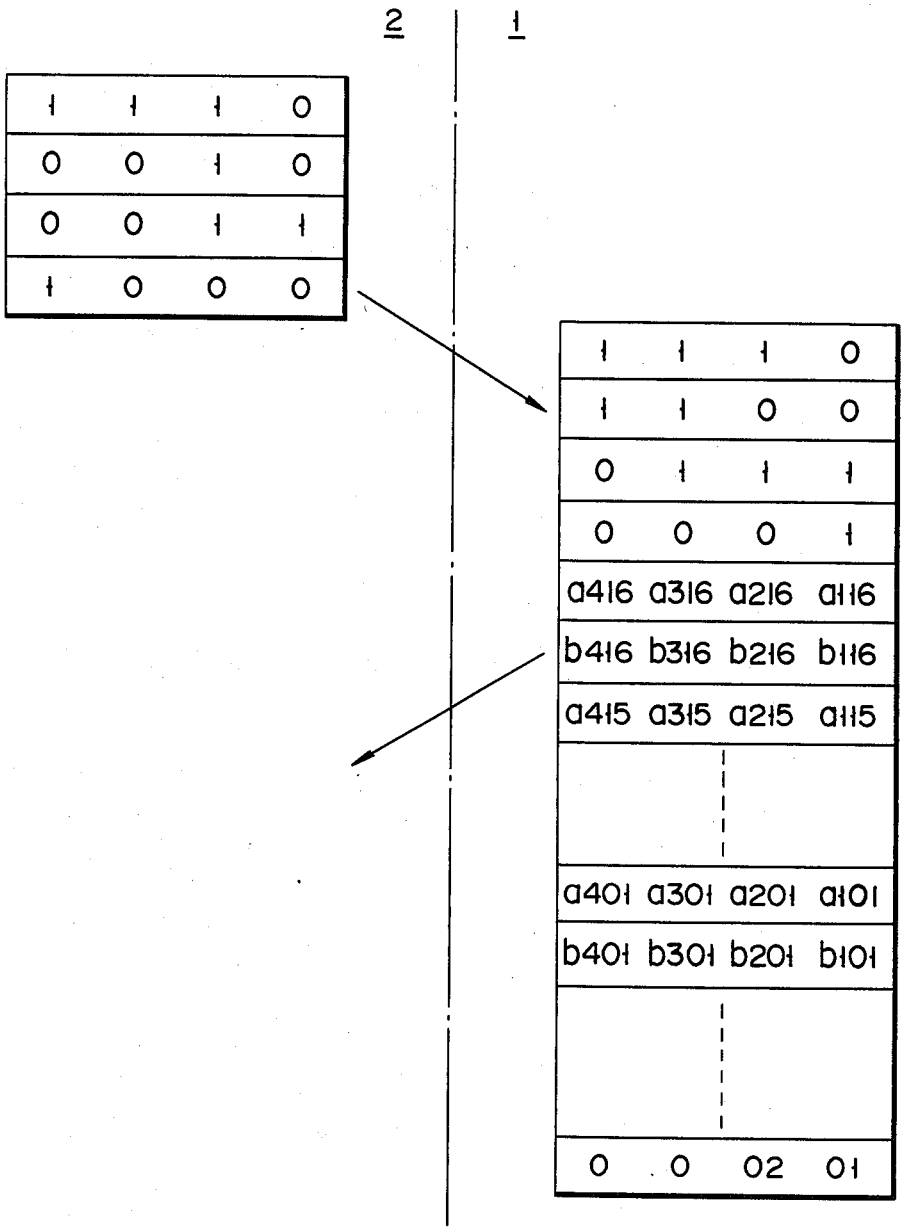
FIG. 11 is a view showing data transferred in response to a request for the transfer of timbre data from a lower keyboard musical instrument L to an upper keyboard musical instrument U.

The operation of this embodiment will now be described with reference to FIG. 11. The upper and lower electronic musical instruments 1 and 2 are connected together, that is, the I/O port 25 of the upper electronic musical instrument 1 and like I/O port of the lower electronic musical instrument 2 are connected together, by the cable CA. The power switches 6 and 13 are then turned on. Subsequently, a timbre may be set from the side of, for instance, the upper electronic musical instrument 1. For example, a timbre switch 5B-8 for timbre number 8 in the timbre switch section 5B is turned on. As a result, the output of the timbre switch 5B-8 for the timbre number 8 is fed to the CPU 2 to be processed therein. Thus, corresponding timbre data is read out from the timbre ROM 26 and fed through the CPU 21 to the RAM 27 to be written therein as shown in FIG. 10. In this case, the waveform data of the timbre number 8 as pair data for the tone waveforms a and b each consisting of 16 steps. Also, the envelope data, filter data, vibrato data and octave data are progressively fed through the CPU 21 to be written. For the writing of the timbre data in the RAM 27, the CPU 21 provides the read/write control signal R/W as write command to the RAM 27 and designates addresses of the RAM 27 by providing successive address data to the address register 28.

When the timbre data has been written in the RAM 27, the CPU 21 reads out only the waveform data in the timbre data, and it transfers the waveform data for the tone waveforms a and b to the RAM 48 and 49 in the tone generator 30 for presetting therein. In this case, the read/write signal R/W is supplied as read command to the RAM 27, while it is supplied as write command to the waveform RAMs 48 and 49. The gate circuits 50 and 51 are alternately enabled and disabled by the gate control signal X with the duty ratio of 1:1 provided from the CPU 21. Thus, waveform data is read out from the first step. First, 4-bit data "a401, a301, a201 and a101" for the tone waveform a is read out, and it is fed through the input terminals A to D, gate circuit 50 and data input terminals I3*a* to I0*a* to be written in the waveform RAM 48. Then, 4-bit data "b401, b301, b201 and b101" for the tone waveform b is read out and fed through the input terminals A to D, gates 50 and 51 and data input terminals I3*b* to I0*b* to be written in the RAM 49. Likewise, waveform data for the second to the sixteenth steps are successively written in the waveform RAMs 48 and 49.

Then, the envelope data A3 to A1, D3 to D1, S3 to S1 and R3 to R1 is read out from the RAM 27 and fed through the CPU 21, tone generator 30 and input terminals A to D to the register 60 to be set therein. Then the filter data "0, f3, f2, f1" is read out from the RAM 27 to be latched in the flip-flop 63 in the tone generator 30 to be fed to the filter 33. The vibrato data is also read out from the RAM 27 to be fed through the selector 23 to the programmable divider 24D in the PLL circuit 24. The PLL circuit 24 thus produces a clock CLK at the frequency corresponding to the preset vibrato data, the clock CLK thus produced being supplied to the tone generator 30. The octave data is further read out from the RAM 27 and fed to the scale discriminator 29. The octave data is thus discriminated, and according to the result of discrimination the CPU 21 determines the compass corresponding to the preset timbre, i.e., timbre number 8, and converts input key code into one in the corresponding octaves, the converted key code being fed to the tone generator 30.

After the presetting operation for the upper electronic musical instrument 1 has been completed, timbre data is now preset for the lower electronic musical instrument 2 in entirely the same key operation. Of course at this time a timbre different from that for the upper electronic musical instrument 1 is set for the lower electronic musical instrument 2.

After the presetting operations described above have been completed, the electronic musical instruments 1 and 2 are now ready for performance of music, that is, the upper electronic musical instrument 1 is ready for generation of tones of the timbre number 8, while the lower electronic musical instrument 2 is ready for generation of tones of a different timbre, e.g., tone number 3.

The operation of tone generation in the upper electronic musical instrument 1 will now be described. A key code that is produced when a key on the keyboard 4 is operated, is fed through the key coder 20, CPU 21 and scale discriminator 29, and converted key code therefrom is fed through the CPU 21 and data bus 31 to the tone generator 30. In the tone generator 30, the octave code in the key code is fed to the octave register 41 thorugh the gate circuit 40, which is enabled at this time by a "1" signal supplied as the gate control signal C2. At the same time, the note code in the key code is fed to the note register 43 through the gate circuit 42, which is enabled at this time by a "1" signal supplied as the gate control signal C1. Note data corresponding to the input note code is read out from the note ROM 44 to be fed to the octave shift section 45, to which is also fed the octave code from the octave register 41. The octave shift section 45 thus shifts the octave code to lower bits to an extent corresponding to the content of the octave code, thus generating the original note data which is fed to the tone clock generator 46. The tone clock generator 46 generates a tone clock corresponding to the input tone data, the tone clock being fed to the address register 47. The address register 47 produces 4-bit address data, which is simultaneously fed to the address input terminals A3*a* to A0*a* and A3*b* to A0*b* of the waveform RAMs 48 and 49 to designate the same address thereof.

Meanwhile, the read/write control signal R/W is supplied as read command to the RAMs 48 and 49, and the gate circuits 53 and 54 are alternately enabled by the gate control signal Y with the duty ratio of 1:1. The waveform data for the tone waveform a thus starts to be read out from the first step from the waveform RAM 48, while the waveform data for the tone waveform b starts to be read out from the first step from the waveform RAM 49, these data being fed to the multiplier 56.

Meanwhile, the ROM 57 provides an envelope clock according to the output of the counter 58, the envelope clock being fed to the envelope control section 59. The frequency of the envelope clock is controlled according to the envelope data in the register 60. The envelope control section 59 produces corresponding envelope waveform data which is fed to the multiplier 56. The status data of envelope, meanwhile, is fed to the ROM 57 so that the envelope clock frequency is switched for each status. The multiplier 56 alternately multiplies the envelope waveform data and the waveform data for the tone waveform a and that for the tone wavefom b by one another and feeds the result data to the adder 61 for addition to the previous result data therein. The sum of the result data is fed to the accumulator 62 for accumulation to data for other keys which are also operated at the same time. The accumulated value data is provided to the D/A converter 32 at the end of each time divsion basis cycle. Thus, a corresponding tone signal is provided to be timbre controlled by the filter 33 and amplified by the amplifier 34 to be sounded through the loudspeaker 9.

During the performance with the upper and lower electronic musical instruments 1 and 2 with different timbres set therefor, the sustain switch 5D may be operated. As a result, the signal ST is provifed from the CPU 21 to be fed to the envelope control section 59. The prevailing envelope waveform is thus rendered to the sustain state. The sustain signal is also transferred to the other electronic musical instrument if the transfer mode switches 5A and 12A of the upper and lower electronic musical instruments 1 and 2 are "on". When the vibrato switch 5E, delay vibrato switch 5F or deep vibrato switch 5G is turned on, the corresponding vibrato data is provided from the vibrato data section 22 to be fed through the selector 23 to the PLL circuit 24, thus providing a new vibrato with a change in the frequency of the output clock CLK.

The operation of the filter 33 will now be described with reference to FIG. 4. When bit data f1 in the filter data "0, f3, f2, f1" is "1", the gate circuit 65 is enabled while the gate circuit 66 is disabled. Thus, timbre control through the high-pass filter HPF becomes valid, and the controlled tone singal is fed to the low-pass filters LPF1 and LPF2 and diode 68. When bit data f1 is "0", the gate circuit 65 is disabled while the gate circuit 66 is enabled. Thus, timbre control through the high-pass filter HPF becomes invalid, and the tone signal free from timbre control is fed to the low-pass filters LPF1 and LPF2 and diode 68.

If data f2 and f3 are both "0" in either of the 123 ove two cases, the transfer gate 70 is enabled while the transfer gates 71 and 72 are disabled. Thus, the low-pass filter LPF1 becomes valid while the other low-pass filter LPF2 becomes invalid. In case with data f2 and f3 being respectively "0" and "1", the transfer gates 70 and 71 are disabled while the transfer gate 72 is endabled. Thus, both the low-pass filters LPF1 and LPF2 become invalid. In case with the data f2 and f3 being respectively "1" and "0", the transfer gates 70 and 72 are disabled while the transfer gate 71 is enabled. Thus, the low-pass filter LPF1 becomes invalid while the low-pass filter LPF2 becomes valid. In case with the data f2 and f3 being both "1", the transfer gate 70 is disabled while the transfer gates 71 and 72 are enabled. Thus, the low-pass filter LPF1 becomes invalid while the low-pass filter LPF2 becomes valid.

As has been shown, various timbre controls are performed depending on the state of the data f1, f2 and f3.

The player who is playing music with the upper and lower electronic musical instruments 1 and 2 with different timbres set therefor, may desire to set an identical timbre for both the electronic musical instruments 1 and 2. In this case, the timbre data for the upper electronic musical instrument 1 is transferred to the lower electronic musical instrument 2. To this end, the transfer mode switches 5A and 12A in the switch input sections 5 and 12 in the upper and lower electronic musical instruments 1 and 2 are turned on. At the same time, the timbre switch 5B-8, for instance, for the timbre number 8 in the upper electronic musical instrument 1 and timbre number set switch 5C are turned on. As a result, the CPU in the lower electronic musical instrument 2 produces operate code "1110" representative of the transfer of timbre data, number of digits data "0010" representing number 2, data "0011" representing a request of timbre data and data "1000" representing timbre number 8, as shown in FIG. 11, and feeds these data to the CPU 21 in the upper electronic musical instrument 1 through the I/O port 25. The CPU 21 in the upper electronic musical instrument 1 decodes the transferred data, and it provides operate code "1110" representing the transfer of timbre, number of digits data "1100" and "0111" representing number 39 and data "0001" representing the transfer of timbre data together with the waveform data, envelope data, filter data, vibrato data and octave data for the timbre number 8 read out from the RAM 27, these data being transferred to the CPU in the lower electronic musical instrument 2 through the I/O port 25. In the lower electronic musical instrument 2, the transferred operate code, number of digits data and contents of data are decoded, and corresponding waveform data and other data are stored as data for the timbre number 8 in a RAM corresponding to the RAM 27. Afterwards, the same timbre of timbre number 8 is provided with the lower electronic musical instrument 2 as with the upper electronic musical instrument 1.

When the same timbre is set for the lower electronic musical instrument 2 as for the upper electronic musical instrument 1, the same content as the kind of vibrato by the operation of the switches 5E, 5F and 5G in the upper electronic musical instrument 1 is automatically set for the lower electronic musical instrument 2. In this case, data from the vibrato data section 22 in the upper electronic musical instrument 1 is transferred to the lower electronic musical instrument 2 through the I/O port 25. The vibrato data directed to the I/O port of the lower electronic musical instrument 2 is fed through CPU corresponding to the CPU 21 to selector corresponding to the selector 23. This selector makes the switches in the lower electronic musical instrument 2 corresponding to the switches 5E, 5F and 5G in the upper electronic musical instrument 1 "no operation" according to a one-bit signal from the CPU. The selector output is fed to a programmable divider corresponding to the programmable divider 24D so that the same kind of vibrato as for the upper electronic musical instrument 1 is set for the lower electronic musical instrument 2. Timbre data may be transferred from the lower electronic musical instrument 2 to the upper instrument 1 in the manner as descried above. This may be accomplished by merely turning on the timbre number set switch and pertinent timbre switch in the lower electronic musical instrument 2.

While the above embodiment has comprised two electronic musical instruments connected together, the invention is also applicable to a case where three or more electronic musical instruments which are capable of setting different timbres are connected to one another. Further, in lieu of connecting together two keyboard type electronic musical instruments, it is possible to incorporate a separate control unit such as a personal computer or like computer.

As has been shown, with the above hybrid electronic musical instrument comprising two or more electronic musical instruments connected to one another, timbre data of one electronic musical instrument can be transferred to the other electronic musical instrument either directly or through control means by simple switch operation. A large number of different timbres thus can be selected for ensemble operation. In addition, since a plurality of electronic musical instruments are connected to one another either directly or through control means for bilateral transfer of data, a wide variety of musical effects can be provided.

With the embodiment shown in FIG. 1, very effective ensemble performance can be emjoyed if the frequencies of tones generated from the lower electronic musical instrument 2 are slightly shifted, for instance about 1.5 cents, with respect to those of the corresponding tones generated from the upper electronic musical instrument 1. Usually, tuning means are provided for manually making fine adjustment of pitches for the invidivual electronic musical instruments 1 and 2. However, it is very cumbersome to tune the instruments such that the pitches of one instrument is shifted by 1.5 cents relative to the other instrument, and it is also difficult to tune the instruments accurately. The following embodiment can overcome these shortcomings. In the following description, what concerns the transfer of timbre data is omitted for it is the same as that in the preceding embodiment of FIGS. 1 to 11.

Figure 12:
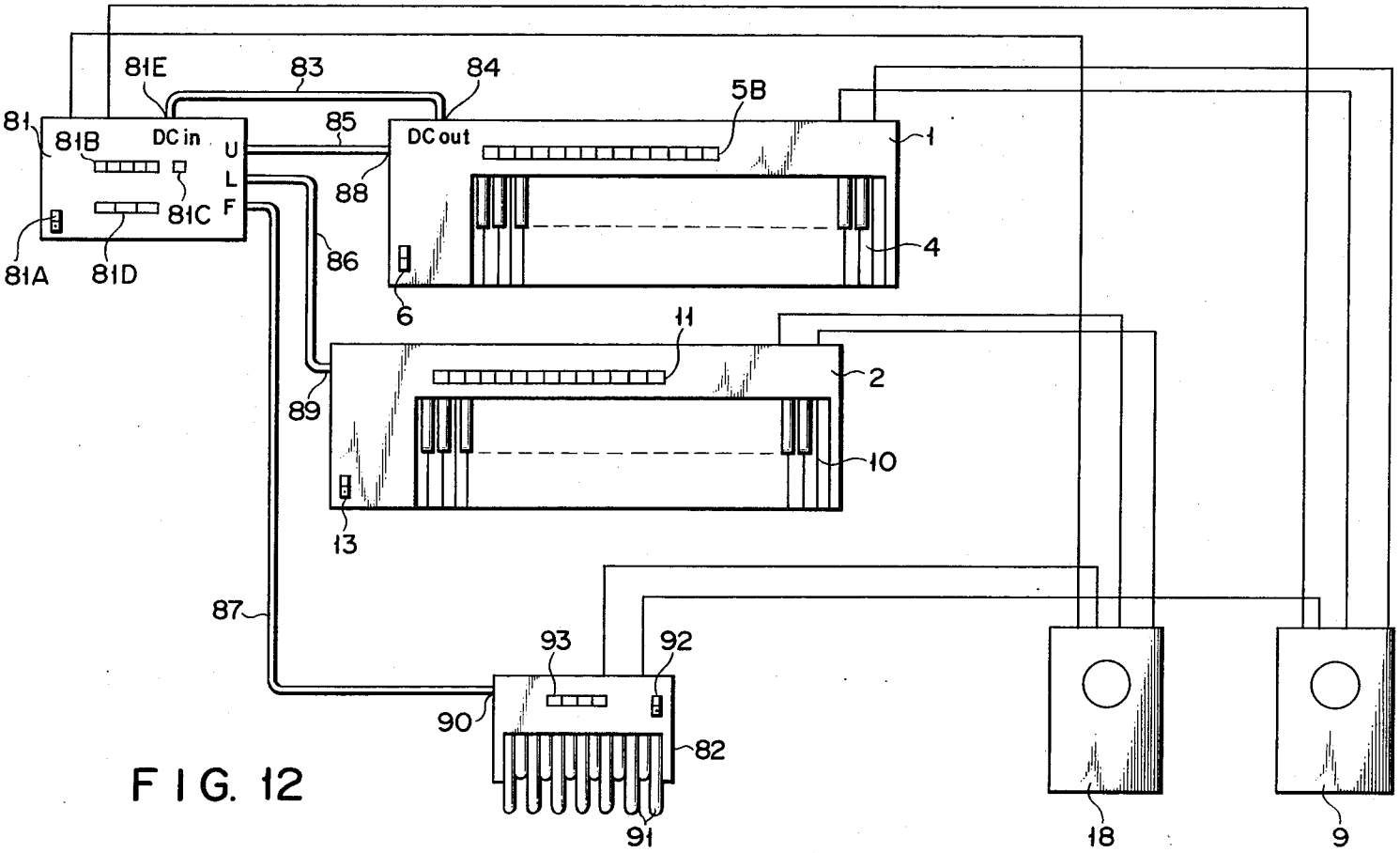
FIG. 12 is a schematic representation of a different embodiment of the invention.

Referring to FIG. 12, a tuning/accompaniment unit 81 is provided for controlling the tuning of upper and lower keyboard musical instruments 1 and 2 and a foot keyborad musical instrument 82 and also for generating rhythm and accompaniment. The tuning/accompaniment unit 81 has a power switch 81A, a rhythm switch section 81B, a start/stop switch 81C and a mode select switch 81D. The rhythm switch section 81B has switches for providing accompaniment rhythm patterns of rock, march, disco, waltz, etc. The start/stop switch 81C is operated for starting and stopping the accompaniment rhythm and also automatic accompaniment chord performance to be described later. The mode select switch 81D is for setting one of three automatic accompaniment modes, i.e., an "off" mode, a finger mode and an "on" mode. In the "off" mode, upper and lower keyboards 4 and 10 can be operated for manual performance of music without automatic accompaniment. In the finger mode, automatic accompaniment can be provided on the accompaniment rhythm according to chords which are produced by holding a low octave key portion of the lower keyboard 10 depressed with left hand fingers. In the "on" mode, automatic accompaniment on the accompaniment rhythm can be provided according to chords specfied by depressing the low octave key portion of the lower keyboard 10 with one, two or three fingers.

The tuning/accompaniment unit 81 further has a DCin terminal 81E, a U terminal, an L terminal and an F terminal. The DCin terminal 81E is connected to a DCout terminal 84 in upper electronic musical instrument 1 via a cord 83 so that DC power is supplied from the upper electronic musical instrument 1 to the unit 81. The U, L and F terminals are connected to C terminals 88, 89 and 90 in the upper and lower musical instruments 1 and 2 and foot keyboard instrument 82 via cords 85, 86 and 87. Through the cords 85, 86 and 87 are transferred tuning setting information and tuning completion information as well as automatic accompaniment mode information and key depression information.

The upper, lower and foot keyboard musical instruments 1, 2 and 82 have respective keyboards 4 and 10 and foot keyboard 91, power switches 6, 13 and 92 and timbre switch sections 5B, 12B and 93. Various timbres such as piano, flute and violin can be selected for the melody performed with the keyboards 4 and 10 and foot keyboard 91 by operating the timbre sections 5B, 12B and 93.

A pair of loudspeakers 9 and 18 are connected to the tuning/accompaniment unit 81 and upper, lower and foot keyboard musical instruments 1, 2 and 82. These loudspeakers 9 and 18 include respective mixers and amplifiers and can stereophonically sound the accompaniment rhythm, automatic accompaniment and melody performed.

Figure 13A:
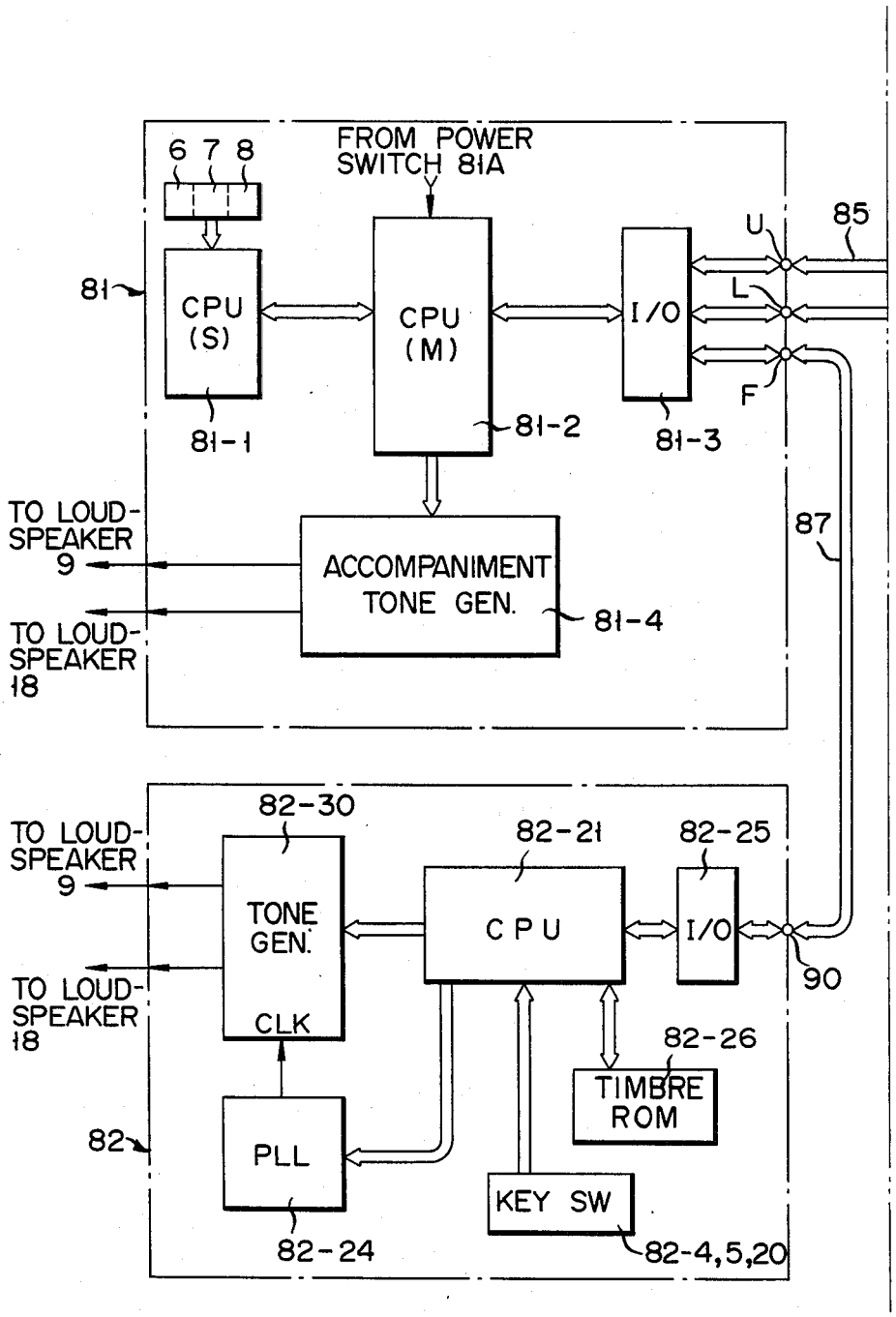
FIGS. 13A and 13B show a block diagram representing the circuit construction of the embodiment shown in FIG. 12.
Figure 13B:
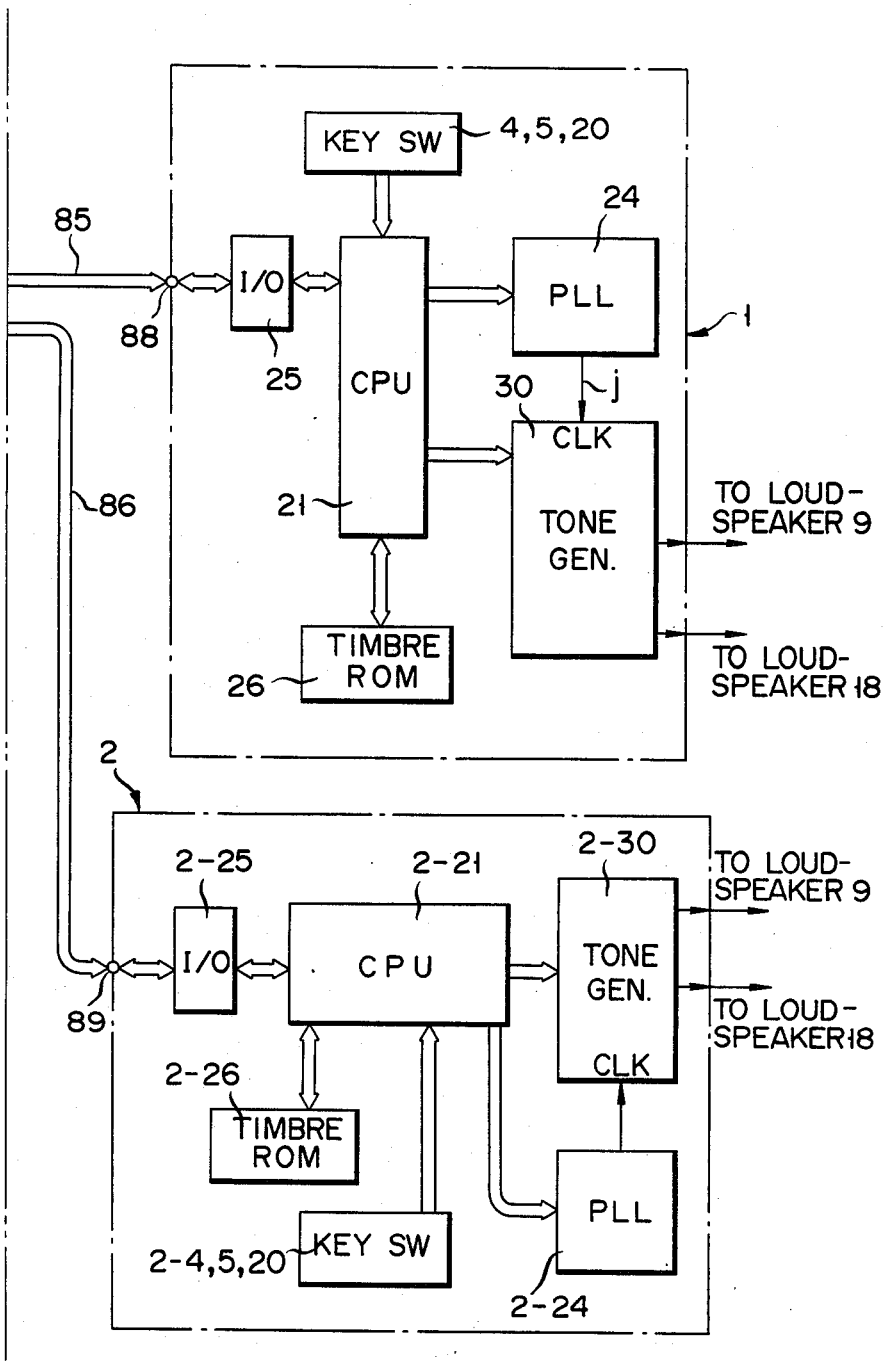

As shown in FIGS. 13A and 13B, the tuning/accompaniment unit 81 includes a subordinate CPU 81-1, a main CPU 81-2, an I/O port 81-3 and an accompaniment tone generator 81-4. The main CPU 81-2 is rendered operative with the closure of the power switch 81A. It feeds tuning setting data to the musical instruments 1, 2 and 82 through the I/O port 81-3. Also, it receives tuning completion data from the musical instruments 1, 2 and 82 for tuning control thereof. Further, it feeds key depression data from the lower keyboard 10 to the subordinate CPU 81-1. Still further, it feeds chord and bass data of automatic accompaniment from the subordinate CPU 81-1 and accompaniment rhythm data corresponding to designated rhythm to the accompaniment tone generator 81-4, and transfers automatic accompaniment mode data from the subordinate CPU 81-1 to the lower keyboard musical instrument 2. The subordniate CPU 81-1 discriminates accompaniment chord according to key depression data from the low octave key ortion of the lower keyboard 10 provided through the main CPU 81-2 and feed chord and bass data for automatic accompaniment to the main CPU 81-2. Also, it detects operation of the rhythm switch 81A and mode select switch 81D and feed accompaniment rhythm data and automatic accompaniment data to the main CPU 81-2. The accompaniment tone generator 81-4 generates tone signals for each accompaniment chord, bass tone and rhythm tone according to the chord and bass data for automatic accompaniment and accompaniment rhythm data, the generated tone signals being fed to and sounded from the loudspeakers 9 and 18.

The main circuit construction of the upper and lower keyboard musical instruments 1 and 2 and foot keyboard musical instrument 82 is identical as shown in FIG. 3.

The upper keyboard musical instrument 1, like the construction shown in FIG. 2, comprises a CPU 21, a PLL 24, a tone generator 30, a key switch section 4, 5, 20, a timbre ROM 26 and an I/O port 25. The key switch section 4, 5, 20 detects the operation of keys on the keyboard 4 and switches in the timbre switch seciton 5B and feeds the detected data as key depression data and timbre designation data to the CPU 21. The CPU 21 feeds the key deperession data from the key switch section 4, 5, 20 to the tone generator 30, and also it reads out timbre data from the timbre ROM 25 according to the timbre designation data and feeds it to the tone generator 30. Also, being rendered operative with the closure of the power switch 6, the CPU 21 feeds tuning setting data from the main CPU 81-2 to the PLL 24. When the feeding of the tuning setting data to the PLL 24 is completed, tuning completion data is fed to the main CPU 81-2.

The lower keyboard musical instrument 2 and foot keyboard musical instrument 82 operate in the same way as the upper keyboard musical instrument 1 except for the following. The lower keyboard musical instrument 2, when it receives automatic accompaniment mode data from the main CPU 81-2, transfers key depression data obtained by operation of the low octave key portion of the keyboard to the main CPU 81-2 through the I/O port 2-25. The foot keyboard musical instrument 82, is a single tone instrument which can generate only a single tone at a time.

Figure 14:
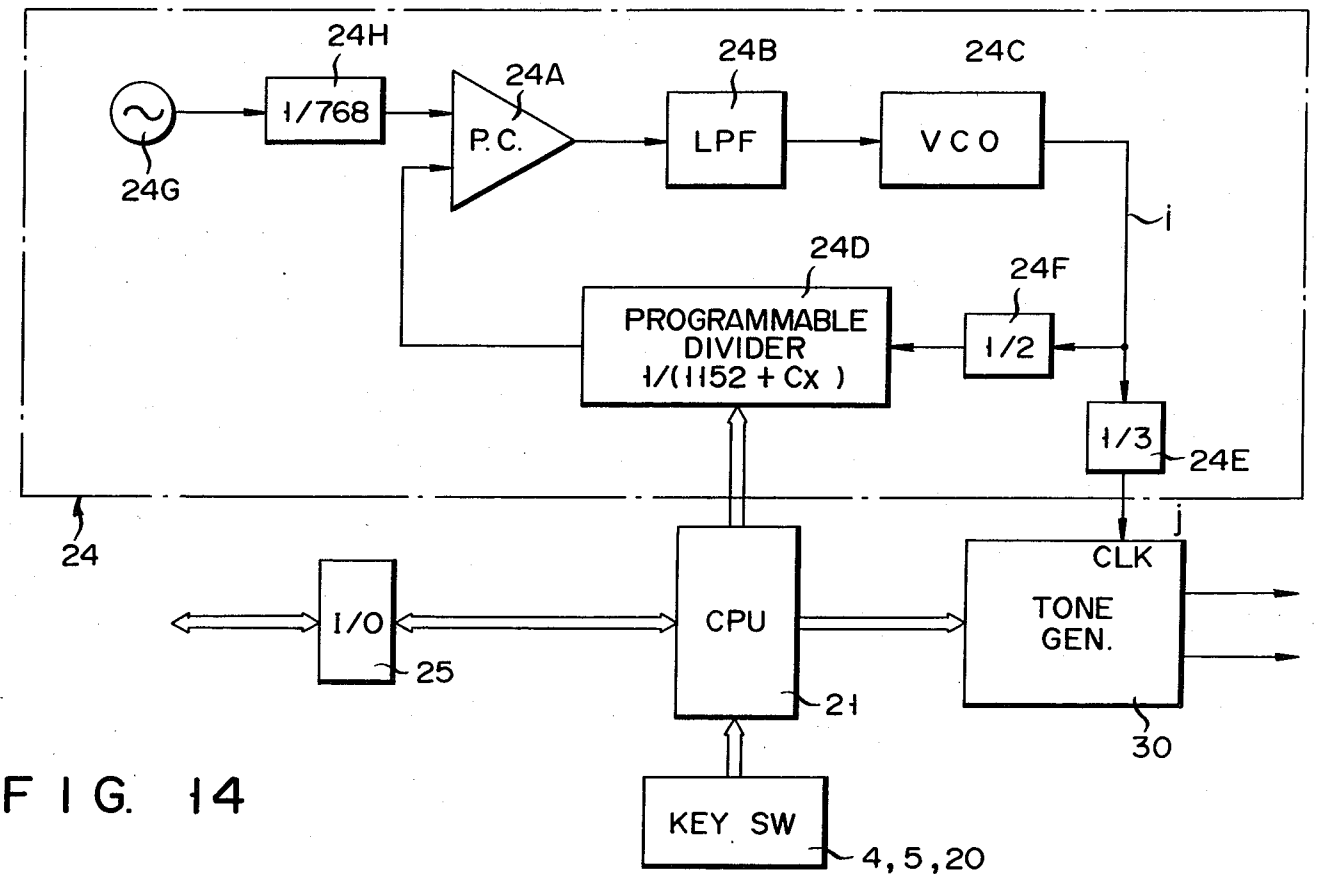
FIG. 14 is a block diagram showing a PLL circuit shown in FIG. 13.

The circuit construction of the PLL 24 will now be described with reference to FIG. 14. As is shown, the PLL 24 comprises a voltage-controlled oscillator (VCO) 24C, a $\frac{1}{3}$ frequency divider 24E, a $\frac{1}{2}$ frequency divider 24F, a programmable divider 24D, a phase comparator (PC) 24A, a low-pass filter (LPF) 24B, a signal source 24G and a 1/768 frequency divider 24H.

The VCO 24C is a circuit with the oscillation frequency thereof controlled by a voltage applied thereto. It provides a signal i at $14{,}840{,}590+(12{,}882\times Cx)$ Hz according to tuning data Cx which is constituted by the tuning setting data. The signal i is fed to the $\frac{1}{3}$ frequency divider 24E, which feeds a tuning signal j at $4{,}946{,}864+(4{,}294\times Cx)$ Hz to the tone generator 30. It is also fed to the $\frac{1}{2}$ frequency divider 24F, which feeds a signal at $7{,}420{,}295+(6{,}441\times Cx)$ to the programmable divider 24D.

The tuning data Cx is given as values "0", "−1" and "−2" to the upper and lower keyboard musical instruments 1 and 2 and foot keyboard musical instrument 82, respectively.

The programmable divider 24D frequency divides the input singal to $1/(1{,}152+Cx)$. Since the input signal is at $7{,}420{,}295+(6{,}4441\times Cx)$ Hz, the frequency division signal of the programmable divider 24D is at 6,441 Hz regardless of the value of the signal Cx, the frequency division signal being fed to the phase comparator 24A. A signal at 6,441 Hz provided from the 1/768 frequency divider 24H, which divides the signal of the signal source 24G, is also fed to the phase comparator 24A, which compares the frequencies of both the input signals and provides a signal if there is a phase difference between the two signals. The low-pass filter 24B extracts the DC component in the output of the phase comparator 24A, the extracted DC component being fed to the VCO 24C to slightly vary the oscillation frequency thereof to thereby compensate for the phase difference.

The tone generator 30 generates tone signals of melody in correspondence to timbre data for key depression data from the CPU 21 according to the tuning signal j from the $\frac{1}{3}$ frequency divider 24E in the PLL 24. The tone signals generated are fed to and sounded from the loudspeakers 9 and 18.

Figure 16:
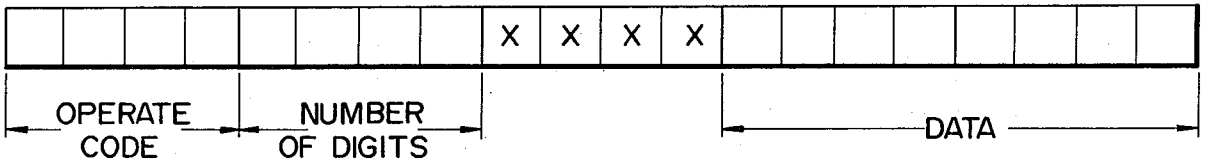
FIG. 16 is a view showing the format of timbre data.
Figure 18:
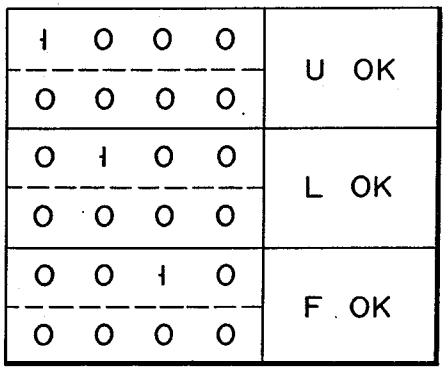
FIG. 18 is a view showing number of digits data.
Figure 17:
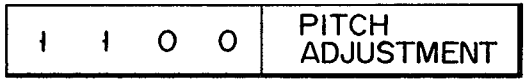
FIG. 17 is the format of an operation code.

In the main CPU 81-2 and CPU 21 include a 20-bit register as shown in FIG. 16 and a 16-bit register (not shown). Tuning data transferred to and from the musical instruments 1, 2 and 82 is temporarily stored in these registers. The data format of the 20-bit register shown in FIG. 16 has a 4-digit configuration with each digit consisting of 4 bits. The upper 4 bits are used for operate code, i.e., a command concerning pitch adjustment, as shown in FIG. 17. The next 4 bits are used for registering the number of digits used in lower 12-bit 3-digit area. The central 4 bits constitute no operation. The lower 8 bits are used for registering tuning data Cx to be described later or tuning completion data for each key as shown in FIG. 18.

Figure 15:
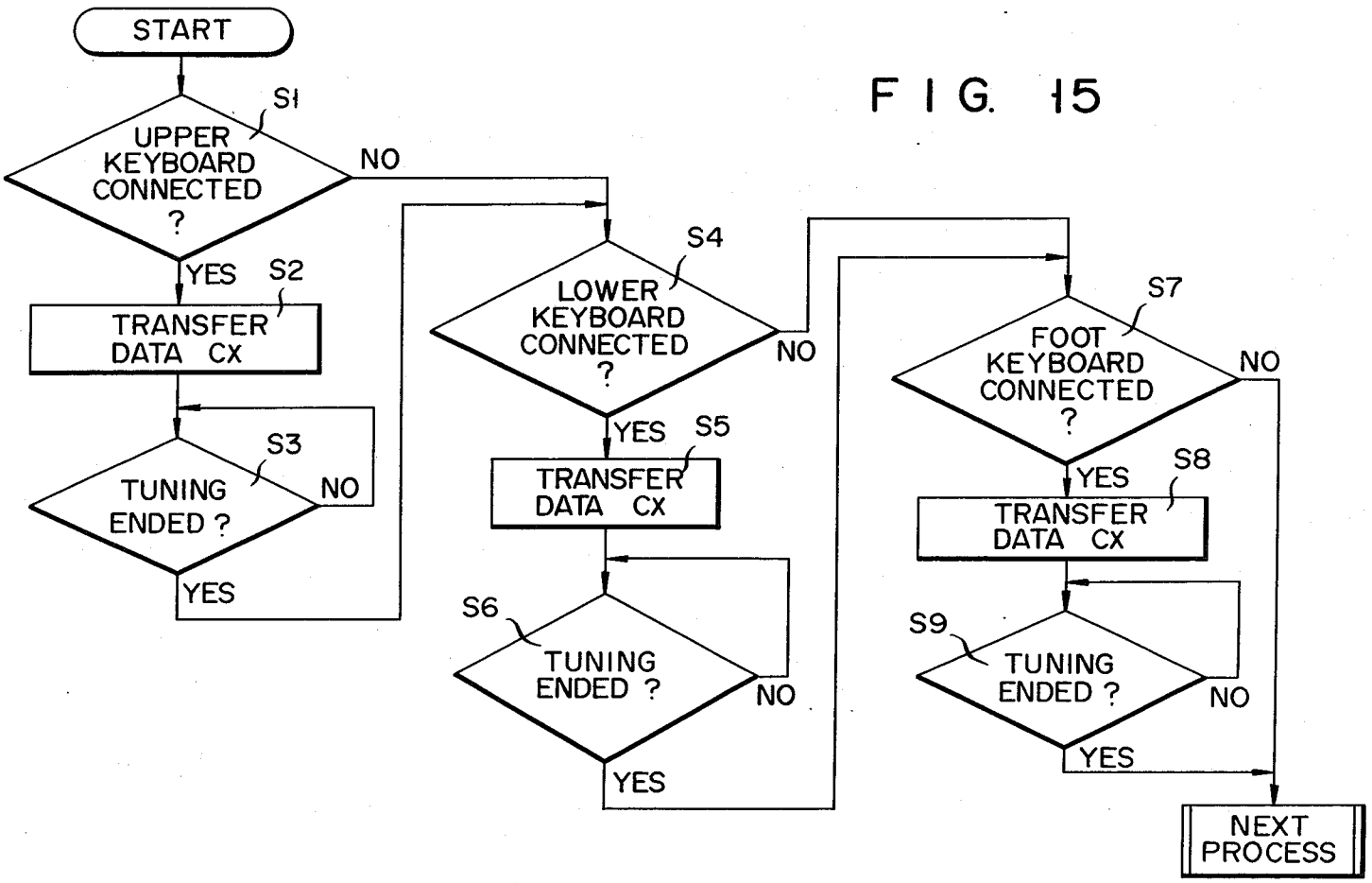
FIG. 15 is a flow chart for explaining the operation of the embodiment shown in FIG. 12.

The operation of this embodiment having the above construction will now be described with reference to the flow chart of FIG. 15.

Figure 19:
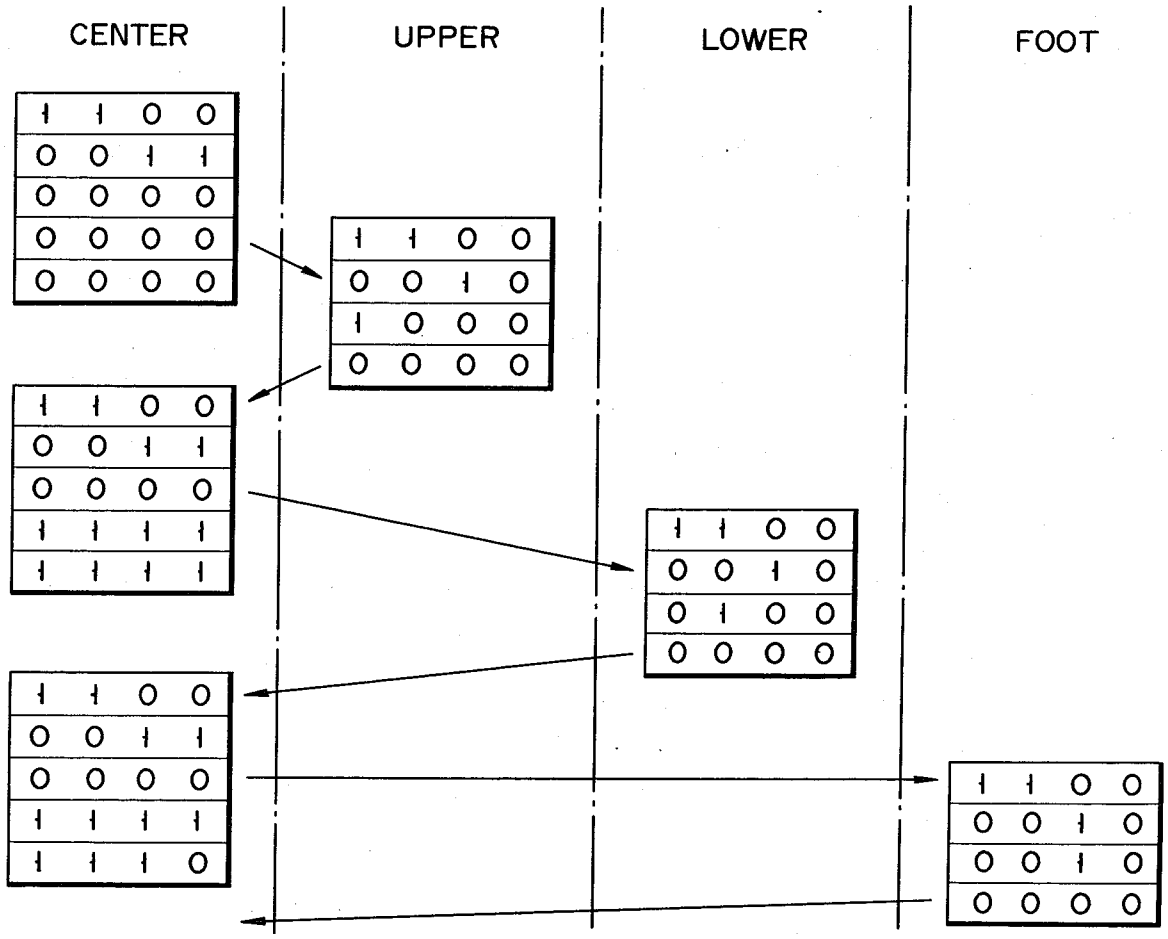
FIG. 19 is a view showing specific data when timbre data is transferred.

First, the power switch 81A of the tuning/accompaniment unit 81 is turned on, and then the power switrch 6 in the upper keyboard musical instrument 1 is turned on. As a result, the main CPUs 81-2 and 21 are rendered operative. The main CPU 81-2 sets in a register a pitch adjustment code "1100" as shown in FIG. 17 as operate code, code "0011" as number of digits data and code "00000000(0)" as tuning data Cx. The set data are transferred as tuning setting data to the CPU 21 in the upper keyboard musical instrument 1 through the I/O ports 81-3 and 25 as shown in FIG. 19. At this time, a check is done as to whether the upper keyboard musical instrument 1 is connected with the cord 85 connected to the U and C terminals (step S1). If not, a step S4 is executed. If it is connected, the tuning data Cx is transferred as tuning setting data to the CPU 21 in the upper keyboard musical instrument 1 (step S2). The data is fed from the CPU 21 to the PLL 24, which feeds the tuning singal j to the tone generator 30 to effect tuning.

Subsequently, the CPU 21 sets in a register a pitch adjustment code "1100" shown in FIG. 17 as operate code, code "0010" as number of digits data and code "10000000" in the upper row shown in FIG. 18 as tuning completion data. These data are transferred as tuning completion data to the main CPU 81-2 (step S3), as shown in FIG. 19, thus bringing an end to the tuning of the upper keyboard musical instrument 1.

When the power switch 13 of the lower keyboard musical instrument 2 is subsequently turned on, a similar check is done as to whether the lower keyboard musical instrument 2 is connected (step S4). If it is connected, tuning setting data is transferred from the main CPU 81-2 to the CPU 2-21 in the lower keyboard musical instrument 2 (step S5) as shown in FIG. 19. Subsequently, tuning completion data is received by the main CPU 81-2, thus bringing an end to the tuning of the lower keyboard musical instrument 2. In this case, the tuning data Cx transferred to the CPU 2-21 is "11111111(−1)", and the tuning completion data received by the main CPU 81-2 is "01000000" in the middle row as shown in FIG. 18.

When the power switch 92 of the foot keyboard musical instrument 82 is turned on, similar tuning control is executed (steps S7, S8 and S9). In this case, the tuning data Cx is "11111110(−2)", and the tuning completion data is "00100000" in the lower row as shown in FIG. 18.

In the above way, tuning signals j at frequencies of 4,946,864 Hz, 4,942,570 Hz and 4,938,276 Hz as basic frequency which are obtained by substituting 0, −1 and −2 for Cx in 4,946,864+(4,294×Cx), are set for the respective musical instruments 1, 2 and 82. These tuning signals j correspond to frequency ratios of 441.6 Hz and 441.2 Hz to the frequency of 442 Hz for note A4. Thus, tones which are shifted by approximately 1.5 cents from one another are produced from the musical instruments 1, 2 and 82. The tuning frequency for the accompaniment tones from the tuning/accompaniment unit 81 is fixed at A4=442 Hz.

While in the above embodiment the tuning of the musical instruments 1, 2 and 82 has been controlled, the setting of timbre and various other effects may be similarly controlled.

In addition, while in the above embodiment the tuning interval has been 1.5 cents, the tuning may be done at different intervals so long as the basic frequency is the same.

Further, while the tuning has been effected in response to the closure of the power switch, it is also possible to permit the tuning of all the electronic musical instruments to be effected by the operation of separate switch means. Furthermore, the electronic musical instruments which are connected together may be provided with respective particular switches, which are operable for the tuning of the corresponding electronic musical instruments.

Further, the tuning/accompaniment unit connected to the plural electronic musical instruments may be replaced with a personal computer or the like which is free from any accompaniment function.

Further, while in the above embodiment the tuning control unit and accompaniment unit have been assembled in a single console, it is possible to assemble only the tuning control unit in an electronic musical instrument with a keyboard. Further, the tuning/accompaniment unit 81 may be assembled in the upper keyboard musical instrument 1, for instance. Of course it is possible to assemble only the tuning control unit in the upper keyboard musical instrument 1.

As has been shown, with the above embodiment, in which a plurality of electronic keyboard musical instruments are connected to a separate tuning control unit which can automatically effect the tuning of the individual electronic musical instruments, the cumbersomeness of manually tuning the musical instruments for ensemble performance can be eliminated, and even a beginner can readily operate the instrument for performance.

In the preceding embodiments descrived in connection with FIGS. 12 through 19, timbre data for a single timbe has been used commonly for a plurality of electronic musical instruments and the tuning of the individual electronic musical instruments has been automatically effected in response to the closure of the respective power switches. According to the invention, it is further possible to permit volume control signal, power source control signal, etc. to be provided in lieu of tuning singal from an electronic musical instrument which is constructed as a master unit and volume control, power source on-off control, etc. of other electronic musical instruments which are constructed as slave units be effected according to these signals.

A further embodiment of the invention, which permits automatic volume control as well as permitting the generation of common timbre data for individual electronic musical instruments, will now be described with reference to FIGS. 1 and 20 through 22.

Referring to FIG. 1, upper electronic musical instrument 1 is constructed as master instrument, and lower electronic musical instrument 2 is constructed as slave instrument. The master instrument 1 has a switch 7A in addition to switch section 5, power switch 6 and volume control knob 7. The switch 7A is adapted such that when it is turned on, it permits the same volume control of the master and slave electronic musical instruments 1 and 2 to be effected by the volume control knob 7. When the switch 7A is "off", on the other hand, the volume control of the slave instrument 2 may be effected with a volume control knob 14 which is provided on this instrument 2 while the volume control of the master instrument 1 may be effected with the volume control knob 7. The slave instrument 2 has switches for designating various kinds of chords, rhythms and timbres for automatic performance, these switches being provided on the case in addition to switch section 12, power switch 13 and volume control knob 14.

The circuit construction of the embodiment will now be described with reference to FIG. 20. In the Figure, portion concerning the processing of timbre data as shown in FIG. 2 is omitted for the sake of simplicity. Outputs from keys on keyboard 4 of the master instrement 1 are fed to tone generator 30 through the CPU 21 shown in FIG. 2. The tone generator 30 generates tone signals corresponding to the operated keys, which are fed to a voltage-controlled amplifier (VCA) 100. The VCA 100 amplifies the tone signal output of the tone generator 30 with an amplification factor, which is analog controlled by a voltage signal from a resistor R, the value of which varies according to the position of volume control knob 7. The output of the VCA 100 is sounded as music sound from loudspeaker 9 including amplifier 34. A predetermined voltage Vcc is applied to one terminal of the resistor R, which is grounded at the other terminal.

In the slave instrument 2, outputs of keys on keyboard 10 are fed to tone generator 2-30, which produce tone singals fed to VCA 101. When the switch 7A is "on", the VCA 101 is analog controlled simultaneously with the VCA 100 to the same value by the voltage signal from the resistor R corresponding to the position of the volume control knob 7, which is transferred to the slave instrument 2 through cable CA. The output of the VCA 101 is sounded as music sound from loudspeaker 9. When the switch 7A is "off", the VCA 101 is analog controlled independently of the VCA 100. The circuit portion including the volume control knob 14 is not shown.

The operation of the above embodiment will now be described. Before the start of performance, the power switches 6 and 13 are turned on to furnish power to the master and slave electronic musical instruments 1 and 2. Then, the switch 7A is turned on if it is desired to effect volume control of both the instruments 1 and 2 with the same voltage signal from the volume control knob 7. As a result, the voltage signal from the resistor R is applied to both the VCAs 100 and 101 for analog control thereof. Thus, tone signals generated from the tone generators 30 and 2–30 according to keyboard operation during performance and fed to the VCAs 100 and 101, are amplified by these VCAs with the same amplification factor, so that the musical tones are sounded from both the loudspeakers 9 and 18 with the same volume.

When effecting volume control independently for the master instrument 1 and for slave instrument 2, the switch 7A is held "off". In this case, the voltage signal from the resistor R, which is variable by operating the volume control knob 7, is fed to the sole VCA 100 and not fed to the VCA 101. The VCA 101, instead, is analog controlled by a voltage signal from a resistor (not shown), which is variable according to the operation of the volume control knob 14. Thus, musical tones are sounded from the loudspeakers 9 and 18 with different volumes in general.

Figure 20:
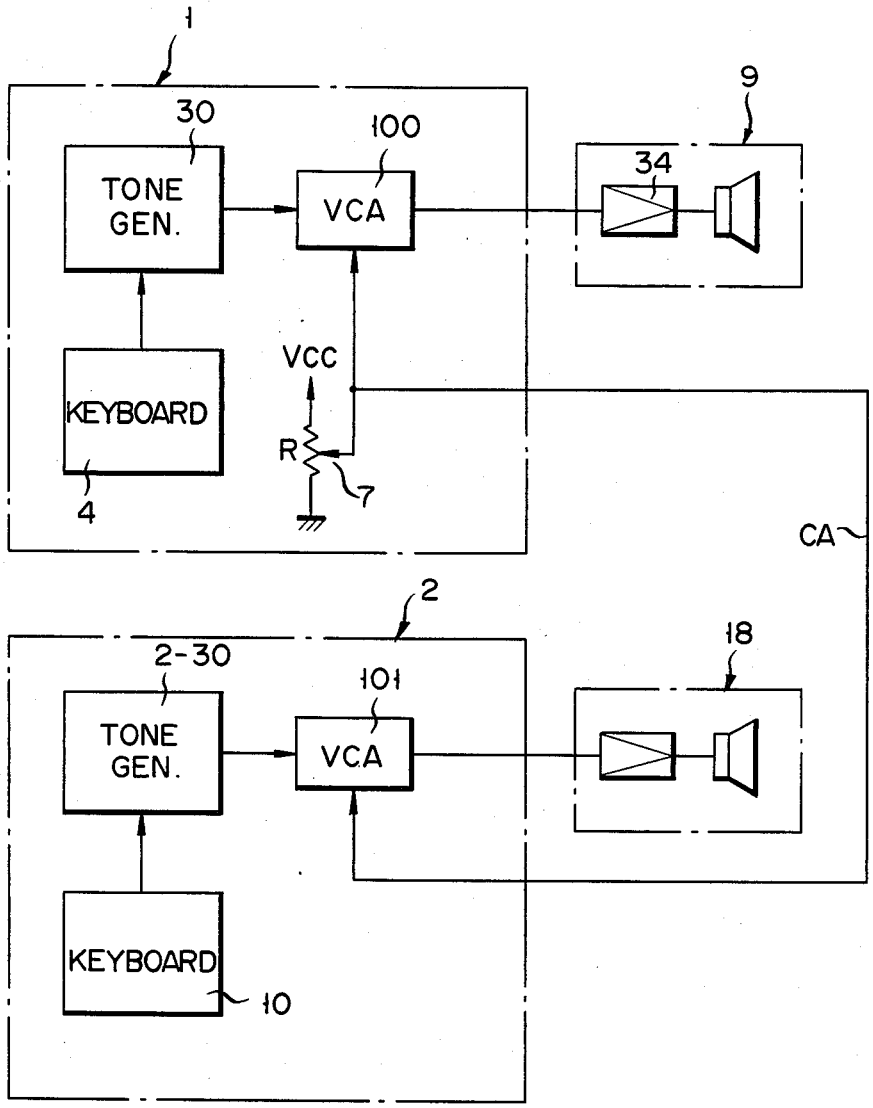
FIG. 20 is a block diagram showing a further embodiment of the invention.
Figure 21:
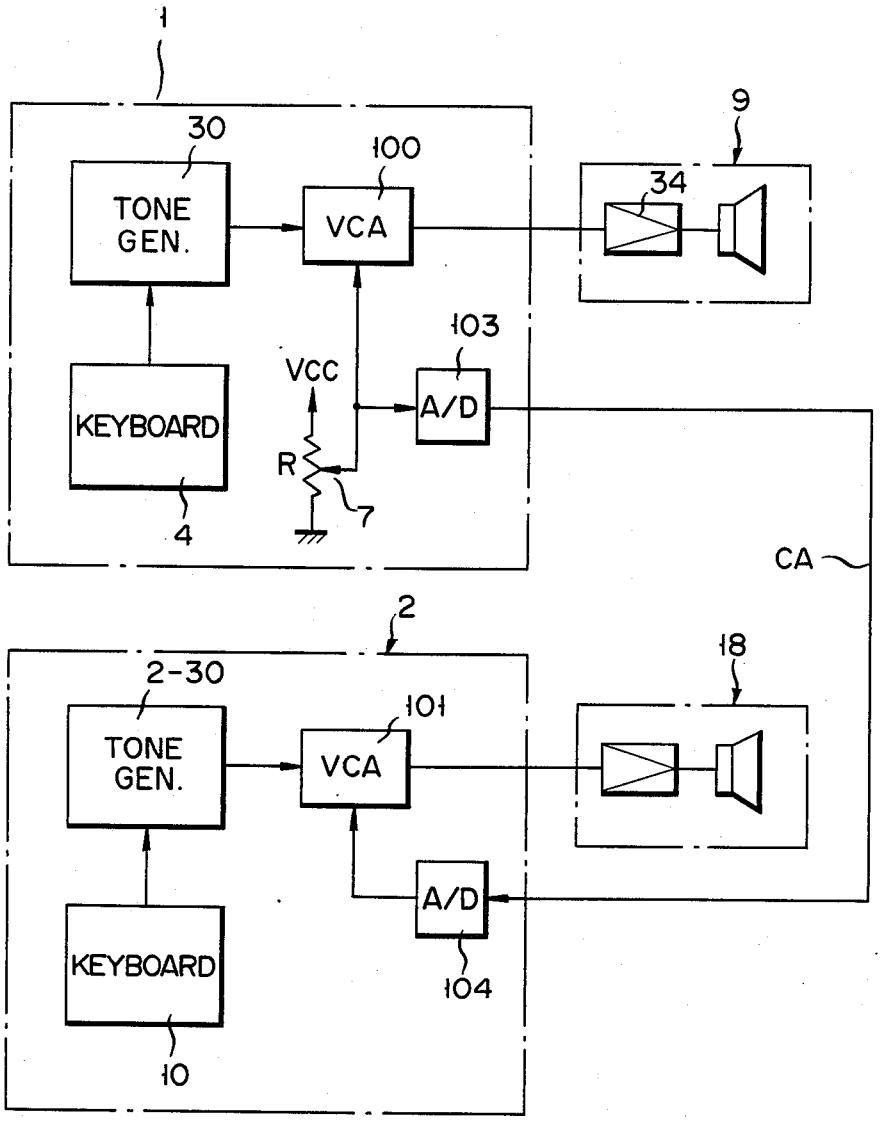
FIG. 21 is a block diagram showing a modification of the embodiment shown in FIG. 20.

FIG. 21 shows a modification of the embodiment of FIG. 20. The modification is different from the preceding embodiment in that the voltage signal from the resistor R variable with the position of the volume control knob 7 in the master electronic musical instrument 1 is converted to a digital signal for transferring to the slave instrument 2 through cable CA. The digital signal is more stable against noise. More specifically, the voltage signal from the resistor R is fed to an A/D converter 103 for conversion to a digital volume control signal which is transferred through the cable CA. The digital volume control signal transferred through the cable CA to the slave instrument 2, is fed to a D/A converter 104 for conversion to an analog volume control signal which is applied to VCA 101. The other construciton is the same as in the embodiment of FIG. 20.

Figure 22:
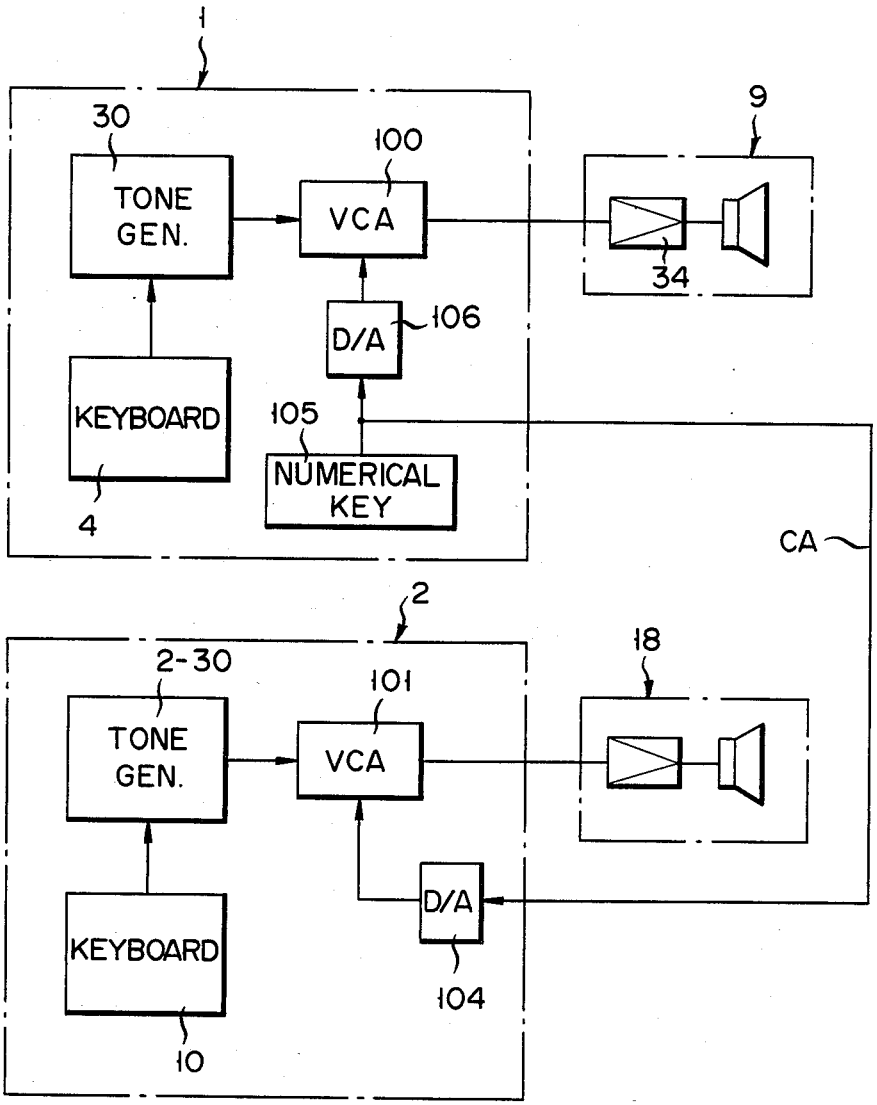
FIG. 22 is a block diagram showing a different modification of the embodiment shown in FIG. 21.

FIG. 22 shows another modification of the embodiment of FIG. 20. This modification is different from the preceding two hybrid electronic musical instruments in that a numeral key section 105, which can provide numerical data, i.e., digital volume control data, is employed in lieu of the volume control knob 7 which provides analog volume control data.

More specifically, the output of the numeral key section 105, which is provided on master instrument 1 in place of the volume control knob 7, is fed through a D/A converter 106 to VCA 100, while it is also transferred through cable CA to slave instrument 2 to be fed through a D/A converter 104 to VCA 100. The other construction is the same as in the cases of FIGS. 20 and 21.

With this construction, digital data corresponding to a desired volume, which is keyed in from the numeral key section 105 during performance, is fed after conversion through the D/A converter 106 to analog data, i.e., analog volume control data to the VCA 100 to control the amplification factor thereof.

Meanwhile, the digital data from the numeral key section 105 is transferred through the cable CA to the D/A converter 104 in the slave instrument 2 for conversion to analog data, i.e., analog volume control data to be fed to the VCA 101. Thus, the amplification factor of both the VCAs 100 and 101 is controlled by the same volume control data. The digital data in this case, like the case of FIG. 21, is stable against noise, so that it can be stably transferred.

In any of the above instances of FIGS. 20 to 22, the volume control of the master and slave electronic musical instruments 1 and 2 is done either commonly or independently depending on whether the switch 7A is "on" of "off". It is possible to omit the switch 7A and arrange such that the volume control of both the electronic musical instruments is effected by the volume control knob 7 on the master instrument 1. Further, while the above instances have concerned with electronic musical instruments in which volume control data is fed to VCAs, in case where digital multipliers are used, particularly in the instance of FIG. 22, it is possible to omit the D/A converters 104 and 106 so that the output of the numeral key section 105 as such. In this case, the construction can be simplified. Further, it is possible to provide two or more slave electronic musical instruments. Still further, the numeral key section 105 may be replaced with a memory which can provide digital data, e.g., a ROM. In this case, the memory content may be read out by operating a predetermined switch or knob, and the readout data may be used as volume control data. Furthermore, a foot keyboard musical instrument as in the embodiment of FIG. 21 may be used in lieu of a hand keyboard musical electronic musical instrument.

As has been shown, with the above embodiment of hybrid electronic musical instrument, in which the volume control of master and slave electronic musical instruments can be effected by a volume control signal generated from volume control signal generating means provided on the master electronic musical instrument, a plurality of electronic musical instruments can be volume controlled by a simple operation compared to prior art instruments, thus permitting the player to devote himself or herself to the musical sentiment of performance that much.

A further embodiment of the invention will now be described, which has a common power source on-off function. Referring again to FIG. 1, upper electronic musical instrument 1 is constructed as master instrument, and lower electronic musical instrument 2 is constructed as slave instrument 2. These electronic musical instruments 1 and 2 are connected together by a cable CA which includes a power source cord. A separate power source cord 110 is also connected to the master instrument 1. When the cord 110 is connected to an indoor power source receptacle, commercial frequency power is supplied simultaneously to both the instruments 1 and 2.

The case of master electronic musical instrument 1 has keyboard 4 and switch section 5 provided on it and also accommodates an electronic circuit and other components. The instrument 1 further has power switch 6, volume control knob 7 and timbre switch section 5B for designating various rhythms and timbres. The case of slave instrument 2 also has keyboard 10 and switch input seciton 12 and accommodates an electronic circuit and other components. The instrument 2 further has power switch 13 and switch section 12B for designating vairous rhythms and timbres.

Figure 23:
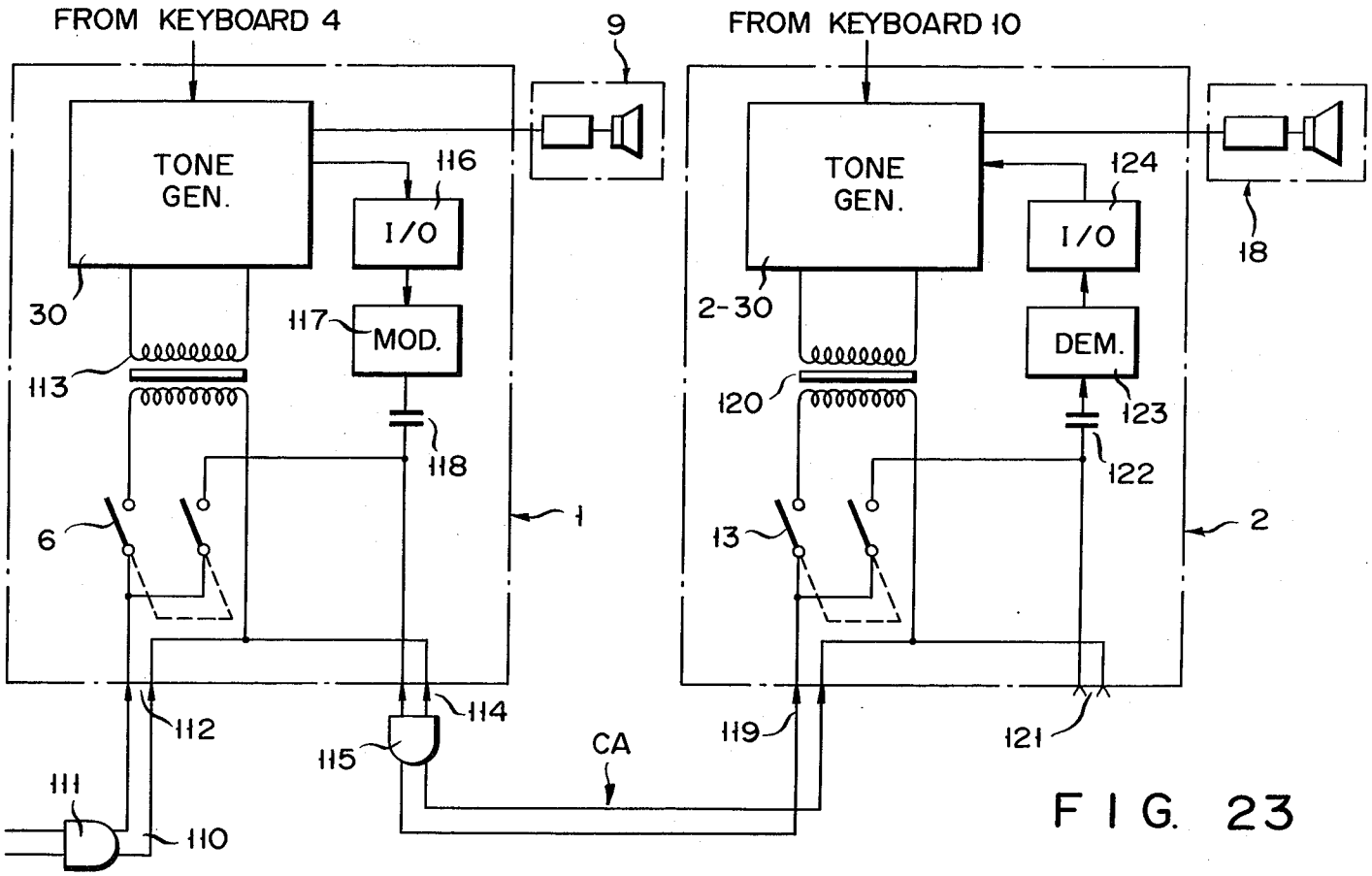
FIG. 23 is a block diagram showing a further embodiment of the invention.

The circuit construction of this embodiment will now be described with reference to FIG. 23. In the master electronic musical instrument, outputs from keys on the keyboard 4 and outputs from switchs in the switch input section 5 are fed to tone generator 30, which generate corresponding tone signals which are sounded from loudsepaker 9.

Reference numeral 111 designates a plug of the power source cord 110. The other end of the power source cord is connected to a power input terminal 112 of the master electronic musical instrument 1. This power input terminal 112 is connected through the power switch 6 to a transformer 113, which is in turn connected to the tone generator 30 to supply AC power thereto. A power output terminal 114 of the master instrument 1 is also connected to the power input terminal 112. A plug 115 of the cable CA is connected to the power output terminal 114.

In the master instrument 1, a digital I/O port 116 is connected to the tone generator 30. The digital I/O port 116 is connected through a modulator 117 and a capacitor 118 to the power output terminal 114. Digital data of timbre, etc. provided from the tone generator 30 thus can be transferred to the slave instrument 2 through the cable CA.

The other end of the cable CA is connected to a power input terminal 119 of the slave instrument 2. The power input terminal 119 is connected through the power switch 13 and a transformer 120 to tone generator 2-30. It is also directly connected to a power output terminal 121. The power input terminal 119 is also connected through the power switch 13, a capacitor 122, a demodulator 123 including a high-pass filter and a digital I/O port 124 to tone generaetor 2-30. The digital data from the master instrument 1 thus can be transferred to the tone generator 2-30. In this case AC/DC rectifying circuits (not shown) are provided in the generators 30 and 2-30 to obtain DC power from the transformers 113 and 120.

The tone generator 2-30 thus has the same function as the tone generator 30 in the master instrument 1. Outputs of keys on keyboard 10 and outputs of switches in switch input section 12 are fed to the tone generator 2-30, and tone signals generated therefrom are sounded from loud-speaker 18.

The operation of this embodiment will now be described. Before the start of performance, the plug 111 of the power cord 110 is connected to an indoor receptacle (not shown). Also, the plug 115 of the cable CA is connected to the power output terminal 114 of the master instrument 1. Where there are two or more slave electronic musical instruments 2, these instruments may be electrically serially connected to the master instrument 1 by connecting the plug of the power cord of another slave instrument to the power output terminal 121 of the illustrated slave instrument 2 and so forth.

Subsequently, the power switch 13 of the slave instrument 2 is turned on, and then the power switch 6 of the master instrument 1 is turned on. As a result, commercial frequency power is supplied from indoor electric cable through the power cord 110 to the power input terminal 112 of the master instrument 1 and thence through the power switch 6 and transformer 113 to the tone generator 30. Also, it is supplied through the power output terminal 114 of the master instrument 1, cable CA, power input terminal 119 of the slave instrument 2, power switch 13 and transformer 120 to the tone generator 2-20. More specifically, power from the indoor electric cable is supplied after conversion to low voltage power by the transformer 113 to the tone generator 30 in the master instrument 1, and also it is supplied after conversion to low voltage power by the transformer 120 to the tone generator 2-30 in the slave instrument 2. In this way, power is simultaneously supplied to the master and slave instruments 1 and 2. Of course where there are two or more slave instruments, power is simultaneously supplied to all the slave instruments as well as to the master instrument 1. Subsequently, tone signals are generated in the tone generator 30 according to key operation on the keyboard 4 of the master instrument 1 and sounded from the loudspeaker 9, while tone signals are also generated in the tone generator 2-30 according to key operation on the keyboard 10 of the slave instrument 2 and sounded from the loudspeaker 18.

When it is desired during performance to transfer digital data designating a timbre, for instance, from the master instrument 1 to the slave instrument 2, a predetermined switch in the switch input section 5 shown in FIG. 1 is operated. As a result, the digital data is provided from the tone generator 30 to be fed through the digital I/O port 116 to the modulator 117 for conversion to a signal at a higher frequency than the commercial power frequency, which is led through the capacitor 118 to the cable CA. The high frequency singal is thus supplied together with commercial frequency power to the slave instrument 2 to be fed through the power switch 13 and capacitor 122 to the demodulator 123 incluiding a high-pass filter for demodulation to the original digital data, which is fed through the digital I/O port 124 to the tone generator 2-30.

As has been shown, with this embodiment, power is simultaneously supplied to both the master and slave electronic musical instruments and also interrupted by turning on and off the power switch of the master instrument after connecting the slave instrument to the master instrument through electric means. That is, power sources for a plurality of electronic musical instruments can be simultaneously on-off operated by simple switch operation. In addition, the connection of the power source line is simplified. Further, the electric connection means is utilized for the transfer of digital data as well as power, thus dispensing with separate data transfer bus.

What is claimed is:

1. A hybrid electronic musical instrument comprising:

a plurality of electronic musical instruments;

means for connecting together said plurality of electronic musical instruments; and control means for making the tuning states of at least two of said connected-together electronic musical instruments different from each other;

said control means being included in at least one of said connected-together electronic musical instruments; and said control means including means for controlling a tuning setting operation for setting the tuning frequency of each of said connected-together electronic musical instruments, said tuning setting operation being executed such that the tuning frequencies of at least two of said connected-together electronic musical instruments are different from each other;

said control means further including means for setting said tuning states in response to the operation of a particular switch including a power source connection switch.

2. A hybrid electronic musical instrument system, comprising:

at least two electronic musical instruments, each of said at least two electronic musical instruments including:

digital timbre data setting means for setting digital timbre data; and tone generating means for generating tones according to the digital timbre data set by said digital timbre data setting means;

connecting means for electrically connecting together said at least two electronic musical instruments;

means for transferring said digital timbre data from one of said at least two electronic musical instruments; and memory means provided in said other of said at least two electronic musical instruments for storing the transmitted digital timbre data from said one of said at least two electronic musical instruments, so as to generate tones according to the transmitted digital timbre data; wherein said digital timbre data setting means in one of said electronic musical instruments includes means for setting a plurality of different timbres which are different from the timbres set by the digital timbre data setting means in the other of said at least two electronic musical instruments.

3. A hybrid electronic musical instrument according to claim 2, further comprising:

a separate control unit for transferring the timbre data set in one of said at least two musical instruments to the other of said at least two musical instruments when said musical instruments are connected together;

said tone generating means of said other musical being capable of generating tones with a timbre based on the transferred timbre data.

4. A hybrid electronic musical instrument according to claim 2, further comprising:

interface circuits each provided in each of said musical instrument; and means for permitting transfer of data to and from said instruments through said interface circuits when said instruments are connected together through said interface circuits.

5. A hybrid electronic musical instrument according to claim 4, further comprising:

a separate control unit for transferring the timbre data set in one of said at least two musical instruments to the other of said at least two musical instruments; and means for permitting transfer of data to and from said instruments through said interface circuits and said separate control unit when said instruments are connected to said separate control unit through said interface circuits.

6. A hybrid electronic musical instrument system, comprising:

at least two electronic musical instruments, each of said at least two electronic musical instruments including:

digital timbre data setting means for setting digital timbre data; and tone generating means for generating tones according to the digital timbre data set by said digital timbre data setting means;

connecting means for electrically connecting together said at least two electronic musical instruments;

means for transferring said digital timbre data from one of said at least two electronic musical instruments; and memory means provided in said other of said at least two electronic musical instruments for storing the transmitted digital timbre data from said one of said at least two electronic musical instruments, so as to generate tones according to the transmitted digital timbre data; wherein said digital timbre data setting means in each of said electronic musical instruments includes:

a plurality of timbre setting switches;

control means for generating a timbre data read signal according to the operation of each of said timbre data setting switches; and a timbre data memory accessed by said timbre data read signal.

7. A hybrid electronic musical instrument according to claim 6, further comprising:

a separate control unit for transferring the timbre data set in one of said at least two musical instruments to the other of said at least two musical instruments when said musical instruments are connected together;

said tone generating means of said other musical instruments being capable of generating tones with a timbre based on the transferred timbre data.

8. A hybrid electronic musical instrument according to claim 6, further comprising:

interface circuits each provided in each of said musical instruments; and means for permitting transfer of data to and from said instruments through said interface circuits when said instruments are connected together through said interface circuits.

9. A hybrid electronic musical instrument according to claim 8, further comprising:

a separate control unit for transferring the timbre data set in one of said at least two musical instruments to the other of said at least two musical instruments; and means for permitting transfer of data to and from said instruments through said interface circuits and said separate control unit when said instruments are connected to said separate control unit through said interface circuits.

* * * * *